US007290846B2

(12) United States Patent
Takahashi

(10) Patent No.: US 7,290,846 B2
(45) Date of Patent: Nov. 6, 2007

(54) PRINTING APPARATUS, PRINTING APPARATUS CONTROL PROGRAM, PRINTING APPARATUS CONTROL METHOD, PRINTING DATA CREATING APPARATUS, PRINTING DATA CREATING PROGRAM AND PRINTING DATA CREATING METHOD

(75) Inventor: Toru Takahashi, Matsumoto (JP)

(73) Assignee: Seiko Epson Corporation (JP)

( * ) Notice: Subject to any disclaimer, the term of this patent is extended or adjusted under 35 U.S.C. 154(b) by 102 days.

(21) Appl. No.: 11/337,910

(22) Filed: Jan. 23, 2006

(65) Prior Publication Data

US 2006/0170721 A1 Aug. 3, 2006

(30) Foreign Application Priority Data

Jan. 28, 2005 (JP) ..... 2005-020835
Sep. 26, 2005 (JP) ..... 2005-278299

(51) Int. Cl.
*B41J 2/205* (2006.01)

(52) U.S. Cl. ..... 347/15; 347/41; 347/43

(58) Field of Classification Search ..... 347/15, 347/40–43

See application file for complete search history.

(56) References Cited

U.S. PATENT DOCUMENTS 6,142,604 A * 11/2000 Kanda et al. ..... 347/41
6,283,571 B1 9/2001 Zhou et al.
6,293,643 B1 9/2001 Shimada et al.
6,328,404 B1 12/2001 Fujimori
6,908,176 B2 6/2005 Koitabashi
2003/0085939 A1 5/2003 Koitabashi
2004/0119766 A1 6/2004 Shibata

FOREIGN PATENT DOCUMENTS

| | | |
|---|---|---|
| JP | 01-235655 | 9/1989 |
| JP | 05-030361 | 2/1993 |
| JP | 11-151821 | 8/1999 |
| JP | 11-254662 | 9/1999 |
| JP | 2000-79710 | 3/2000 |
| JP | 2000-190470 | 7/2000 |
| JP | 2000-225716 | 8/2000 |
| JP | 2002-019101 | 1/2002 |
| JP | 2003-136702 | 5/2002 |
| JP | 2003-063043 | 3/2003 |
| JP | 2004-058284 | 2/2004 |

* cited by examiner

*Primary Examiner*—Thinh Nguyen
(74) *Attorney, Agent, or Firm*—Harness, Dickey & Pierce, P.L.C.

(57) ABSTRACT

A printing apparatus which is capable of printing an image on a printing medium by a print head having a nozzle that is capable of creating two or more types of dots varied depending on size, and a printing module that prints the image on the medium by the print head based on the printing data.

12 Claims, 22 Drawing Sheets

FIG.10A

| NOZZLE NUMBER | DISCHARGE/NO DISCHARGE INFORMATION |
|---|---|
| 1 | 0 |
| 2 | 0 |
| 3 | 1 |
| · | |
| · | |
| · | |
| 1438 | 0 |
| 1439 | 1 |
| 1440 | 0 |

0: NORMAL DISCHARGE, 1: NO DISCHARGE (CLOG)

FIG.10B

| NOZZLE NUMBER | RELATIVE CURVED FLIGHT AMOUNT (RELATIVE DISCHARGE ACCURACY) [μm] (RELATIVE CURVED FLIGHT AMOUNT FROM IDEAL POSITION OF NOZZLE NUMBER N + 1 - RELATIVE CURVED FLIGHT AMOUNT FROM IDEAL POSITION OF NOZZLE NUMBER N) |
|---|---|
| 1 | −1 |
| 2 | −3 |
| 3 | +1 |
| · | |
| · | |
| · | |
| 1438 | +4 |
| 1439 | +3 |
| 1440 | – |

| RELATIVE CURVED FLIGHT AMOUNT X [μm] | NO-DISCHARGE, DISCHARGE/NO DISCHARGE SETTINGS |
|---|---|
| $x \leqq -6$ | NO DISCHARGE SETTING |
| $-6 < x \leqq -3$ | DISCHARGE/NO DISCHARGE FEASIBLE SETTING |
| $-3 < x \leqq +3$ | DISCHARGE FEASIBLE SETTING |
| $+3 < x \leqq +6$ | DISCHARGE/NO DISCHARGE FEASIBLE SETTING |
| $x \geqq +6$ | NO DISCHARGE SETTING |

FIG.11A

| RELATIVE CURVED FLIGHT AMOUNT X [μm] | NO-DISCHARGE, DISCHARGE/NO DISCHARGE SETTINGS |
|---|---|
| $-6 < x \leqq -5$ | 1/4 OF PIXEL COLUMNS IS DISCHARGED, 3/4 IS NOT DISCHARGED |
| $-5 < x \leqq -4$ | 1/2 OF PIXEL COLUMNS IS DISCHARGED, 1/2 IS NOT DISCHARGED |
| $-4 < x \leqq -3$ | 3/4 OF PIXEL COLUMNS IS DISCHARGED, 1/4 IS NOT DISCHARGED |
| $+3 < x \leqq +4$ | 3/4 OF PIXEL COLUMNS IS DISCHARGED, 1/4 IS NOT DISCHARGED |
| $+4 < x \leqq +5$ | 1/2 OF PIXEL COLUMNS IS DISCHARGED, 1/2 IS NOT DISCHARGED |
| $+5 < x \leqq +6$ | 1/4 OF PIXEL COLUMNS IS DISCHARGED, 3/4 IS NOT DISCHARGED |

FIG.11B

| | 0 | 1 | 2 | 3 | · | 720 | 721 | 722 | · | 1438 | 1439 |
|---|---|---|---|---|---|---|---|---|---|---|---|
| 0 | 0 | 0 | 0 | 1 | | 1 | 1 | 0 | | 1 | 0 |
| 1 | 0 | 0 | 1 | 1 | | 1 | 1 | 0 | | 1 | 0 |
| 2 | 0 | 0 | 0 | 0 | | 1 | 1 | 0 | | 0 | 0 |
| 3 | 0 | 1 | 1 | 0 | | 1 | 0 | 0 | | 0 | 0 |
| 4 | 0 | 0 | 0 | 1 | | 1 | 0 | 0 | | 1 | 0 |
| · | | | | | | 1 | | 0 | | | 0 |
| 1435 | 0 | 1 | 0 | 1 | | 1 | 1 | 0 | | 1 | 0 |
| 1436 | 0 | 0 | 1 | 0 | | 1 | 0 | 0 | | 0 | 0 |
| 1437 | 0 | 0 | 0 | 0 | | 1 | 1 | 0 | | 0 | 0 |
| 1438 | 0 | 0 | 1 | 1 | | 1 | 1 | 0 | | 1 | 0 |
| 1439 | 0 | 1 | 0 | 0 | | 1 | 0 | 0 | | 0 | 0 |

NOTE) 0: NORMAL DISCHARGE, 1: NOT DISCHARGE

FIG.12

PIXEL COLUMN FOR DISCHARGE/NO DISCHARGE FEASIBLE SETTING

| | 0 | 1 | 2 | · | 720 | 721 | 722 | · | 1438 | 1439 |
|---|---|---|---|---|---|---|---|---|---|---|
| 0 | 0 | 0 | 0 | | 0 | 0 | 0 | | 0 | 0 |
| 1 | 0 | 0 | 0 | | 0 | 0 | 1 | | 0 | 0 |
| 2 | 0 | 0 | 0 | | 0 | 1 | 0 | | 0 | 0 |
| 3 | 0 | 0 | 0 | | 0 | 0 | 1 | | 0 | 0 |
| 4 | 0 | 0 | 0 | | 0 | 0 | 0 | | 0 | 0 |
| · | | | | | | | | | | |
| 1435 | 0 | 0 | 0 | | 0 | 1 | 0 | | 0 | 0 |
| 1436 | 0 | 0 | 0 | | 0 | 0 | 0 | | 0 | 0 |
| 1437 | 0 | 0 | 0 | | 0 | 0 | 1 | | 0 | 0 |
| 1438 | 0 | 0 | 0 | | 0 | 1 | 0 | | 0 | 0 |
| 1439 | 0 | 0 | 0 | | 0 | 0 | 1 | | 0 | 0 |

NOTE) 0: NORMAL DISCHARGE,
1: NOT DISCHARGE

RELATIVE CURVED FLIGHT AMOUNT IS '+4<x≦+5' 1/3 IS NOT DISCHARGED

RELATIVE CURVED FLIGHT AMOUNT IS '-4<x≦-5' 1/3 IS NOT DISCHARGED

FIG.13

| | 0 | 1 | 2 | 3 | · | 720 | 721 | 722 | · | 980 | 981 | · | 1438 | 1439 |
|---|---|---|---|---|---|---|---|---|---|---|---|---|---|---|
| 0 | 0 | 0 | 0 | 1 | | 1 | 1 | 0 | | 0 | 0 | | 1 | 0 |
| 1 | 0 | 0 | 1 | 1 | | 1 | 1 | 0 | | 1 | 0 | | 1 | 0 |
| 2 | 0 | 0 | 0 | 0 | | 1 | 1 | 0 | | 0 | 1 | | 0 | 0 |
| 3 | 0 | 1 | 1 | 0 | | 1 | 0 | 0 | | 1 | 0 | | 0 | |
| 4 | 0 | 0 | 0 | 1 | | 1 | 0 | 0 | | 0 | 0 | | 1 | 0 |
| · | 0 | | | | | 1 | | 0 | | | | | | 0 |
| 1435 | 0 | 1 | 0 | 1 | | 1 | 1 | 0 | | 0 | 0 | | 1 | 0 |
| 1436 | 0 | 0 | 1 | 0 | | 1 | 0 | 0 | | 1 | 1 | | 0 | 0 |
| 1437 | 0 | 0 | 0 | 0 | | 1 | 1 | 0 | | 0 | 0 | | 0 | 0 |
| 1438 | 0 | 0 | 1 | 1 | | 1 | 1 | 0 | | 1 | 0 | | 1 | 0 |
| 1439 | 0 | 1 | 0 | 0 | | 1 | 0 | 0 | | 0 | 1 | | 0 | 0 |

NOTE) 0: NORMAL DISCHARGE, 1: NOT DISCHARGE

FIG.14

CURVED FLIGHT
(A SHIFT RIGHTWARD MORE THAN AN IDEAL POSITION)
CAUSES A BLACK STREAK (THICK STREAK)

NO CORRECTION PROCESS

1/2 OF PIXELS IS SET NOT DISCHARGED TO
LESSEN A BLACK STREAK (THICK STREAK)

WITH CORRECTION PROCESS

DOTS ARE GREATER THEREAROUND

NO CORRECTION PROCESS

WITH CORRECTION PROCESS

PRINTING APPARATUS, PRINTING APPARATUS CONTROL PROGRAM, PRINTING APPARATUS CONTROL METHOD, PRINTING DATA CREATING APPARATUS, PRINTING DATA CREATING PROGRAM AND PRINTING DATA CREATING METHOD

RELATED APPLICATIONS

This application claims priority to Japanese Patent Application Nos. 2005-20835 filed Jan. 28, 2005 and 2005-278299 filed Sep. 26, 2005 which are hereby expressly incorporated by reference herein in their entirety.

BACKGROUND

1. Technical Field

The present invention relates to a printing apparatus, a printing apparatus control program, and a printing apparatus control method, which are used for printing equipment such as a facsimile machine, a copier, and OA appliances, particularly to a so-called ink jet printing apparatus, a printing apparatus control program, a printing apparatus control method, a printing data creating apparatus, a printing data creating program, and a printing data creating method in which fine particles of multiple colors of liquid ink are discharged onto printing paper (recording material) to draw predetermined letters and images.

2. Related Art

Hereinafter, a printing apparatus, particularly a printer that adopts the ink jet printing method (hereinafter, it is called 'an ink jet printer') will be described.

Generally, since the ink jet printer easily provides inexpensive, high quality color prints, it becomes widespread in offices as well as general users with the wide use of personal computers and digital cameras.

Typically, the ink jet printer like this produces desired prints in which a movable body called a carriage having an ink cartridge and a print head in one piece discharges (injects) liquid ink particles in dots from a nozzle of the print head while reciprocating over a printing medium (for example, printing paper) in the direction vertical to the paper feed direction and predetermined letters and images onto the medium are drawn. Then, four colors of ink cartridges including black (black, yellow, magenta, and cyan) and print heads for each color are provided in this carriage to facilitate monochrome printing as well as full color printing combining each color (furthermore, such a ink jet printer is also commercially available that is provided with six and seven colors, or eight colors such as light cyan and light magenta added to these colors).

Moreover, in the ink jet printer of this type that printing is done while the print head over the carriage reciprocates in the direction vertical to the paper feed direction, the print head needs to reciprocate for a few tens to a hundred times or more in order to print an entire page beautifully. Thus, as compared with a printing apparatus in other methods such as a laser printer using electrophotographic technology including a copier, it has a disadvantage that it takes time to print.

On the other hand, in an ink jet printer of the type that a long print head having the same width (or longer than) as that of printing paper is disposed without using any carriage, the print head does not need to move in the width direction of printing paper, and printing is done in a so-called single scan (a single path). Therefore, high speed printing is feasible similarly to the laser printer. Furthermore, since a carriage that mounts the print head thereon and a drive system that moves the carriage are unnecessary, this printer has advantages that a printer housing can be reduced in size and weight, and silence properties can be improved significantly. Moreover, the ink jet printer by the former method is generally called a 'multipath type printer', and the ink jet printer by the latter method is generally called a 'line scan head type printer' or 'serial printer'.

In the meantime, since the print head essential for the ink jet printer like these is formed in which a fine nozzle having a diameter of about 10 to 70 μm is arranged in a row spaced at a predetermined distance or in multiple rows in the printing direction, a so-called 'curved flight phenomenon' sometimes occurs that fabrication error causes a part of nozzles to be tilted in the ink discharge direction thereof, or that the position of a nozzle is placed at the position shifted from an ideal position and then the position of dot shot formed by that nozzle is shifted from an ideal position. Furthermore, because of the variations in the property of the nozzle, for the nozzle with greater variations, there are some nozzles that an ink amount is greatly larger or smaller than an ideal amount.

Consequently, printed failure, a so-called 'banding (streaks) phenomenon,' is generated in the portion printed with the defective nozzle, and print quality is sometimes seriously degraded. More specifically, when the 'curved flight phenomenon' occurs, the distance between dots discharged from the adjacent nozzles becomes uneven, 'white streaks (when printing paper is white)' are generated in the portion where the distance between adjacent dots is longer than that in normal printing, and 'thick streaks' are generated in the portion where the distance between adjacent dots is shorter than that in normal printing. Furthermore, also when the value of the ink amount is deviated from an ideal value, thick streaks are generated in the portion relating to the nozzle with a greater ink amount, and white streaks are generated in the portion relating to the nozzle with a smaller ink amount.

Particularly, such the banding phenomenon tends to occur more noticeably in the 'line scan head type printer' that the print head or a medium for use in printing is fixed (single path printing) than in the 'multipath type printer' (serial printer) described above (in the multipath type printer, there is a technique to make banding less noticeable by making use of reciprocating the print head many times).

Therefore, in order to prevent a kind of printed failure like this 'banding phenomenon', studies and development are devotedly done in so-called hardware including improvements in fabrication techniques and in designs of the print head, but it is difficult to provide a print head that never generates the 'banding phenomenon' in view of fabrication cost and techniques.

Then, under the current circumstances, in addition to the improvements in hardware, a technique is also used to reduce the 'banding phenomenon' using so-called software schemes such as print control shown below.

For example, in JP-A-2002-19101 and JP-A-2003-136702, in order to cope with nozzle variations and no ink discharge, settings are done to make banding and variations less noticeable in such ways that head variations are handled by using a shading compensation technique for portions with thin concentrations, and that other colors are used for substitutes for portions with thick concentrations (for example, when printing is done in black, cyan, magenta, etc., are substituted).

Moreover, in JP-A-2003-63043, a scheme is adopted for a solid image (that is, it is an image having a relatively great area with respect to a line image, which is covered with ink densely, but is sometimes not covered entirely because of edge effect), in which the discharge amount of nozzles adjacent to neighboring pixels of a misfired nozzle is increased to generate a solid image by all the nozzles.

Furthermore, in JP-A-5-30361, an amount of variations in each of nozzles is fed back to error spread and processed, and variations in the discharge amount of ink discharged from the nozzles are smoothed out to prevent the banding phenomenon.

Moreover, in JP-A-2004-58284, when there is a nozzle (N) that abnormality occurs in an ink discharge state, record data corresponding to that abnormal nozzle (N) is added to record data corresponding to neighboring nozzles (N−1) and (N+1) located near the abnormal nozzle (N), and record data corresponding to the abnormal nozzle (N) is corrected to prevent the banding phenomenon.

However, in the schemes that reduce the banding phenomenon and variations using other colors such as the techniques in JP-A-2002-19101 and JP-A-2003-136702, the schemes are not suitable for printing requiring high resolution and high quality as color photograph image printing because the hue of the processed portions is changed.

Furthermore, for portions with thick concentrations, in the scheme that information about the no discharge nozzle is distributed in right and left to prevent the 'white streak phenomenon', the scheme can reduce white streaks when it is adopted to 'the curved flight phenomenon' described above, but it has a problem that banding still remains in portions with thick concentrations.

Moreover, in the scheme such as technique of the JP-A-2003-63043, no problem occurs when prints are solid images, but the scheme cannot be used for halftone prints. Besides, the scheme that buries fine lines with other colors does not cause any problem for slight use, but for an image where different colors are created continuously, a problem remains that the hue of the image is partially changed similarly to the former scheme.

Furthermore, in the scheme such as the technique of the JP-A-5-30361, for the problem that dot forming descriptions are shifted, there is a problem that the process of proper feedback is complicated for difficult solution.

Moreover, in the scheme such as the technique of the JP-A-2004-58284, when dots have the γ property in creating dots in different size by surrounding nozzles after binarization, a problem occurs that the area ratio gray scale in that portion is likely to be deformed.

SUMMARY

A first advantage of the invention is to provide a novel printing apparatus, a printing apparatus control program, a printing apparatus control method, a printing data creating apparatus, a printing data creating program, and a printing data creating method, which can eliminate the degradation of printed image quality or make it little noticeable.

Furthermore, a second advantage is to provide a novel printing apparatus, a printing apparatus control program, a printing apparatus control method, a printing data creating apparatus, a printing data creating program, and a printing data creating method, which can eliminate the degradation of printed image quality due to the banding phenomenon caused by the curved flight phenomenon or make it little noticeable.

Moreover, a third advantage is to provide a novel printing apparatus, a printing apparatus control program, a printing apparatus control method, a printing data creating apparatus, a printing data creating program, and a printing data creating method, which can eliminate the degradation of printed image quality caused by ink discharge deficiency or make it little noticeable.

Aspect 1

In order to achieve the first to third advantages, a printing apparatus according to aspect 1 is a printing apparatus which is capable of printing an image on a medium by a print head having a nozzle that is capable of creating two or more types of dots varied in size on a printing medium, the printing apparatus including:

a first image data acquiring module that acquires first image data having a plurality of items of pixel data corresponding to an M-ary pixel value (M≧3);

a nozzle information storing module that stores nozzle information indicating a property of the nozzle;

a nozzle use information setting module that sets whether to use a nozzle corresponding to each item of pixel data for each item of the pixel data of the first image data based on the nozzle information;

a second image data creating module that changes to a minimum concentration value a pixel value of pixel data set not to use a nozzle by the nozzle use information setting module in the first image data, and creates second image data that an original pixel value before changed is distributed to a pixel value of an unprocessed pixel located near that pixel value;

an N-ary formation process module that performs an N-ary formation process to create third image data, the process being that an M-ary pixel value (M≧3) of pixel data in second image data is transformed to an N-ary value (M>N≧2);

a printing data creating module that creates printing data that defines information about dot forming descriptions of the nozzle corresponding to the third image data; and a printing module that prints the image on the medium by the print head based on the printing data.

With this configuration, the image data acquiring module can acquire first image data including a plurality of items of pixel data corresponding to an M-ary pixel value (M≧3). The nozzle information storing module can store nozzle information indicating a property of the nozzle. The nozzle use information setting module can set whether to use a nozzle corresponding to each item of pixel data for each item of the pixel data of the first image data based on the nozzle information. The second image data creating module can change to a minimum concentration value a pixel value of pixel data set not to use a nozzle by the nozzle use information setting module in the first image data, and can create second image data that an original pixel value before changed is distributed to a pixel value of an unprocessed pixel located near that pixel value. The N-ary formation process module can perform an N-ary formation process to create third image data, the process being that an M-ary pixel value (M≧3) of pixel data in second image data is transformed to an N-ary value (M>N≧2); The printing data creating module can create printing data that defines information about dot forming descriptions of the nozzle corresponding to the third image data. The printing module can print the image on the medium by the print head based on the printing data.

Therefore, based on nozzle information, for pixel data relating to the 'banding phenomenon' that is caused by nozzle properties that are generated from ink discharge deficiency in a nozzle and 'the curved flight phenomenon' in a nozzle that the dot forming position is shifted from an ideal position, the nozzle corresponding to that pixel data is set disused for part or all items of that pixel data, and the pixel value of that pixel data can be changed to the minimum concentration value as well as the original pixel value can be distributed to surrounding pixel data. Thus, after the N-ary formation process using an error spread scheme, pixel data at the portion where the nozzle is set disused creates a relatively small dot or no dots in accordance with the N-ary formation process method. Furthermore, the pixel value of a value lost from pixel data at the portion where the nozzle is set disused is corrected by surrounding pixel data. Therefore, an advantage can be obtained that can reduce the degradation of printed image quality such as 'white streaks' and 'thick streaks' while the original area ratio gray scale is maintained.

Here, the dot is a single area formed in such a way that ink discharged from a single or a plurality of the nozzles is reached on a printing medium. Moreover, a 'dot' area is not 'zero', but it of course has a fixed size (area), and has a plurality of types depending on the size. However, the dot formed by discharging ink is not always a perfect circle. For example, when a dot is formed in an oval figure other than a perfect circle, the following cases can be considered. The average diameter may be treated as a dot diameter; and a dot equivalent to a perfect circle having an area equal to the area of a dot formed by discharging a certain amount of ink may be considered to treat the diameter of the equivalent dot as the dot diameter. Moreover, for a method of separately shooting dots with different concentrations, for example, the following methods can be considered. A method of shooting dots having the same diameters and different concentrations, a method of shooting dots having the same concentrations and different size, a method of shooting dots having the same concentrations and a different ink discharge amount by shooting dots overlappingly to vary concentrations, and so on. Furthermore, it is also considered to create a single dot when one ink droplet discharged from a single nozzle is shot separately. However, when two or more dots created from two or more nozzles or a single nozzle at different times come together, it is considered to create two dots. Hereinafter, it is the same in aspects related to 'the printing apparatus control program', aspects related to 'the printing apparatus control method', aspects related to 'the printing data creating apparatus', aspects related to 'the printing data creating program', aspects related to 'the printing data creating method', aspects related to 'the recording medium recorded with the program', the description of exemplary embodiments, and so on.

Moreover, the first image data acquiring module acquires image data inputted from an optically printed result read module such as a scanner module, passively or actively acquires image data stored in an external unit through a network such as LAN and WAN, acquires image data from a recording medium such as CD-ROM and DVD-ROM through a drive unit such as a CD drive and a DVD drive held by the printing apparatus, and acquires image data stored in a memory unit held by the printing apparatus. More specifically, the acquisition at least includes input, attainment, reception and readout. Hereinafter, it is the same in aspects related to 'the printing apparatus control program', aspects related to 'the printing apparatus control method', aspects related to 'the printing data creating apparatus', aspects related to 'the printing data creating program', aspects related to 'the printing data creating method', aspects related to 'the recording medium recorded with the program', the description of exemplary embodiments, and so on.

Furthermore, the nozzle information storing module stores nozzle information by every means and at every time. It may store nozzle volume information beforehand, or may store nozzle information by external input during the operation of the printing apparatus without storing nozzle information beforehand. The timing at which nozzle information is stored is any timing that can make the state where storing has been performed in use of that product. For example, before the printing apparatus is commercially available as a product, at the time of factory shipment, for example, an optically printed result read module such as a scanner module is used to inspect nozzle information such as a shift of the dot forming position of nozzles forming the print head and an ink discharge state of a nozzle from the printed result by the print head and the inspected result is stored beforehand. And, in use of the printing apparatus, similarly to the factory shipment time, a shift of the dot forming position of nozzles forming the print head and an ink discharge state of a nozzle from the printed result by the print head are inspected to store the inspected result. Moreover, nozzle information may be updated in such a way that after use of the printing apparatus, in order to cope with the case where the properties of the print head are varied, the optically printed result read module such as the scanner module is used periodically or at a predetermined time to inspect nozzle information such as a shift of the dot forming position of nozzles forming the print head and an ink discharge state of a nozzle from the printed result by the print head and the inspected result is stored along with data at the time of factory shipment or is rewritten to the data and stored. Hereinafter, it is the same in aspects related to 'the printing apparatus control program', aspects related to 'the printing apparatus control method', aspects related to 'the printing data creating apparatus', aspects related to 'the printing data creating program', aspects related to 'the printing data creating method', aspects related to 'the recording medium recorded with the program', the description of exemplary embodiments, and so on.

Furthermore, ink discharge deficiency is a state where ink cannot be discharged ideally in such states that ink cannot be discharged, the ink discharge amount is short, the ink discharge amount is too much, and ink cannot discharged at an ideal position.

Moreover, the minimum concentration value is a value that concentrations become the minimum in the range of the gray scale value of an image. For example, when the gray scale of an image is expressed by eight bits (0 to 255), the pixel value is '255' in the brightness value, whereas it is '0' in the concentration value.

Furthermore, information about dot forming descriptions of the nozzle is configured of information necessary in creating dots by a nozzle such as information about the presence of dots (whether to create dots according to nozzles) with respect to each pixel value of image data, and information about dot size to be created (for example, any one of three types, large, middle and small). For example, when only a single size is available, the information may be configured of information about the presence of dots.

Moreover, as described above, the 'banding phenomenon' is printed failure that 'white streaks' as well as 'thick streaks' are generated in the printed result at the same time caused by a so-called 'curved flight phenomenon' due to a nozzle whose dot forming position is shifted from an ideal forming position, and printed failure that 'white streaks' and 'thick streaks' are generated in the printed result caused by ink discharge deficiency such as no ink discharge from a nozzle. Hereinafter, it is the same in aspects related to 'the printing apparatus control program', aspects related to 'the printing apparatus control method', aspects related to 'the printing data creating apparatus', aspects related to 'the printing data creating program', aspects related to 'the printing data creating method', aspects related to 'the recording medium recorded with the program', the description of exemplary embodiments, and so on.

Furthermore, for example, the 'white streaks' are a portion (area) that a phenomenon where the distance between adjacent dots is wider than a predetermined distance because of 'the curved flight phenomenon' continuously occurs to make the base color of a printing medium noticeable in streaks. Also, the 'thick streaks' are a portion (area) that a phenomenon where the distance between adjacent dots is shorter than a predetermined distance because of 'the curved flight phenomenon' similarly continuously occurs to make the base color of a printing medium invisible, or a portion (area) that the distance between adjacent dots is shorter to see relatively thicker, or a portion (area) that a part of dots formed as shifted is overlapped with normal dots to make the overlapped portion noticeable in thick streaks. Moreover, white streaks sometimes occur because of the nozzle with a small ink amount, whereas thick streaks sometime's occur because of the nozzle with a large ink amount. Hereinafter, it is the same in aspects related to 'the printing apparatus control program', aspects related to 'the printing apparatus control method', aspects related to 'the printing data creating apparatus', aspects related to 'the printing data creating program', aspects related to 'the printing data creating method', aspects related to 'the recording medium recorded with the program', the description of exemplary embodiments, and so on.

Furthermore, the error spread scheme is a scheme similar to a publicly-known error spread scheme that is one scheme of the N-ary formation processes. For example, in the case of performing a binarization process for the M-ary image data in which it is transformed to '0' when the pixel value is smaller than '128' whereas it is transformed to '255' when the pixel value is equal to or greater than '128'. When the pixel value of the selected pixel is '101', '101' is transformed to '0', the difference '101' between '0' after transformed and '101' before transformed is considered as an error, and the difference is spread to pixels around the selected pixel that do not undergo binarization in accordance with a predetermined spread scheme.

Aspect 2

Moreover, in the printing apparatus of aspect 1, a printing apparatus according to aspect 2, wherein:

the nozzle information includes information indicating whether or not a presence of ink discharge deficiency in the nozzle; and the nozzle use information setting module sets a nozzle disused for all pixel data corresponding to the nozzle with the ink discharge deficiency.

With this configuration, nozzles with ink discharge deficiency can be distinguished easily, such nozzles that cannot discharge ink, have a shorter ink discharge amount, and have a greater ink discharge amount. Also, nozzles can be set disused for all pixel data corresponding to such nozzles. Therefore, for example, such a situation can be prevented that the pixel value of pixel data corresponding to the nozzle that cannot discharge ink is not corrected by surrounding pixels. An advantage can be obtained that reduces the degradation of printed image quality such as 'white streaks' and 'thick streaks' due to the 'banding phenomenon' caused by 'ink discharge deficiency' while the original area ratio gray scale is maintained.

Here, since whether or not the presence of ink discharge deficiency in the nozzle can be detected by a CCD sensor, for example, provided for the printing apparatus, information indicating whether or not the presence of ink discharge deficiency can be created based on the sensed result. Hereinafter, it is the same in aspects related to 'the printing apparatus control program', aspects related to 'the printing apparatus control method', aspects related to 'the printing data creating apparatus', aspects related to 'the printing data creating program', aspects related to 'the printing data creating method', aspects related to 'the recording medium recorded with the program', the description of exemplary embodiments, and so on.

Aspect 3

Furthermore, in the printing apparatus of aspect 1 or 2, a printing apparatus according to aspect 3, wherein the nozzle information includes information about a position shift between an actual position of the dot formed by the nozzle and an ideal forming position of that dot.

With this configuration, a nozzle can be distinguished easily, the nozzle might cause a so-called 'curved flight phenomenon' that occurs by shifting the dot forming position from an ideal forming position, as well as the magnitude of an amount of curved flight can be obtained. Therefore, it can be set properly whether to use a nozzle for pixel data corresponding to such a nozzle, and the number of items of pixel data that the nozzle is set disused can be varied in accordance with the magnitude of an amount of curved flight. Thus, nozzles are properly set used/disused to prevent the 'banding phenomenon' caused by 'the curved flight phenomenon', and an advantage can be obtained that can properly reduce the degradation of printed image quality such as 'white streaks' and 'thick streaks' due to the 'banding phenomenon' caused by 'the curved flight phenomenon'.

Aspect 4

Moreover, in the printing apparatus of aspect 3, the printing apparatus according to aspect 4, wherein the nozzle use information setting module sets a nozzle disused for part of pixel data corresponding to a nozzle having a position shift greater than a predetermined amount.

With this configuration, a nozzle can be set disused for pixel data corresponding to a nozzle having an amount of curved flight greater than a predetermined amount, and concentrations of pixel data that the nozzle is set disused can be spread to surrounding pixels. Therefore, an advantage can be obtained that can properly reduce the degradation of printed image quality such as 'white streaks' and 'thick streaks' due to the 'banding phenomenon' caused by 'the curved flight phenomenon'.

Here, for a method of specifying 'part of pixel data corresponding to the nozzle having a position shift greater than a predetermined amount', there is a method in such a way that a probability is determined which sets a nozzle disused with a position shift greater than a predetermined amount in accordance with print resolution and part of pixel data corresponding to the nozzle having a position shift greater than a predetermined amount is decided based on the probability. For example, when print resolution is low, a probability is reduced which sets a nozzle disused with a shift position greater than a predetermined amount (for example, 10%), when print resolution is high, a probability is increased which sets a nozzle disused with a shift position greater than a predetermined amount (for example, 30%). Hereinafter, it is the same in aspects related to 'the printing apparatus control program', aspects related to 'the printing apparatus control method', aspects related to 'the printing data creating apparatus', aspects related to 'the printing data creating program', aspects related to 'the printing data creating method', aspects related to 'the recording medium recorded with the program', the description of exemplary embodiments, and so on.

Aspect 5

Furthermore, in any one of pieces of the printing apparatus of aspects 1 to 4, a printing apparatus according to aspect 5, wherein in the process that distributes the original pixel value, the second image data creating module distributes the original pixel value before changed to a pixel value of pixel image located near pixel image of that pixel value at a random ratio.

With this configuration, the pixel value can be distributed at a random distribution ratio in distributing the original pixel value. Therefore, banding can be less noticeable than in regular distribution at the same distribution ratio, and an advantage can be obtained that can improve image quality of the printed result.

Here, the 'random ratio' can be determined in such a way that random numbers are generated by a random number generator and a random number generation program, for example, and the generated random numbers are used to compute a ratio for distribution. For example, there is a method in which the numeric range of random numbers is divided into multiple parts, a ratio computing table is prepared beforehand that registers computing methods with different ratios to each of the divided numeric ranges (for example, error spread matrices at different spread ratios), a computing method is selected at a ratio matched with the random numbers from that table, and the selected method is used to compute a distribution ratio. In this manner, the ratio is decided at random to result in different distributed result at each time for processing in doing the same image process (however, when the same random numbers are generated continuously, the same result is sometimes obtained). In reverse, the ratio is decided not at random, the same distributed result is obtained at each time for processing in doing the same image process. Hereinafter, it is the same in aspects related to 'the printing apparatus control program', aspects related to 'the printing apparatus control method', aspects related to 'the printing data creating apparatus', aspects related to 'the printing data creating program', aspects related to 'the printing data creating method', aspects related to 'the recording medium recorded with the program', the description of exemplary embodiments, and so on.

Aspect 6

Moreover, in any one of pieces of the printing apparatus of aspects 1 to 5, a printing apparatus according to aspect 6 wherein:

the nozzle use information setting module creates a nozzle setting information table formed of information that sets whether to use a nozzle corresponding to each item of pixel data for each item of the pixel data in the first image data; and the N-ary formation process module creates the third image data that the second image data is formed in an N-ary form based on the nozzle setting information table.

With this configuration, for example, in the case of the N-ary formation process using an error spread scheme, when error from surrounding pixels is spread to the pixel value (the minimum concentration value) that the nozzle is set disused by the error spread scheme and the pixel value is changed to create dots, third image data can be created so as not to create dots for pixel data that the nozzle is disused based on the nozzle setting information table, even in the state that dots are created. Therefore, printing data is created from this third image data surely not to create dots at the position where no dots are created. Thus, an advantage can be obtained that can further reduce the degradation of image quality caused by the banding phenomenon.

Aspect 7

Furthermore, in any one of pieces of the printing apparatus of aspects 1 to 5, a printing apparatus according to aspect 7 wherein:

the nozzle use information setting module creates a nozzle setting information table formed of information that sets whether to use a nozzle corresponding to each item of pixel data for each item of the pixel data in the first image data; and the printing data creating module creates the printing data that the third image data is corrected based on the nozzle setting information table.

With this configuration, for example, in the case of the N-ary formation process using an error spread scheme, in creating third image data by the error spread scheme, when error from surrounding pixels is spread to the pixel value (the minimum concentration value) that the nozzle is set disused by the error spread scheme and the pixel value is changed to create dots, third image data can be corrected to create printing data so as not to create dots for pixel data that the nozzle is disused based on the nozzle setting information table, even in the state that dots are created. Thus, an advantage can be obtained that can further reduce the degradation of image quality caused by the banding phenomenon.

Aspect 8

Moreover, in any one of pieces of the printing apparatus of aspects 1 to 5, a printing apparatus according to aspect 8 wherein:

the nozzle use information setting module creates a nozzle setting information table formed of information that sets whether to use a nozzle corresponding to each item of pixel data for each item of the pixel data in the first image data; and the printing module prints the image on the medium by the print head based on the printing data and the nozzle setting information table.

With this configuration, for example, in the case of the N-ary formation process using an error spread scheme, when error from surrounding pixels is spread to the pixel value (the minimum concentration value) that the nozzle is set disused by the error spread scheme and the pixel value is changed to create dots, the print head can be controlled for printing so as not to create dots for pixel data that the nozzle is disused based on the nozzle setting information table, even in the state that dots are created. Thus, an advantage can be obtained that can further reduce the degradation of image quality caused by the banding phenomenon.

Aspect 9

Furthermore, in any one of pieces of the printing apparatus of aspects 1 to 8, a printing apparatus according to aspect 9, wherein the print head is a print head that the nozzle is continuously arranged across an area equal to a mounting area of the medium or an area wider than the mounting area.

With this configuration, as described above, an advantage can be obtained that can create printing data effective to make 'white streaks' and 'thick streaks' less noticeable, the streaks tend to be particularly generated by the banding phenomenon when the line scan head type print head is used that completes printing by a so-called single path.

Aspect 10

Moreover, in any one of pieces of the printing apparatus of aspects 1 to 8, a printing apparatus according to aspect 10, wherein the print head is a print head that prints as moves in a direction orthogonal to a paper feed direction of the medium.

The banding phenomenon described above is noticeably seen in the line scan head type print head, but it also occurs in the multipath type print head. Therefore, when any one of printing methods according to the aspects 1 to 9 is adapted to the multipath type print head, an advantage can be obtained that can create printing data effective to make 'white streaks' and 'thick streaks' less noticeable, the streaks are caused by the banding phenomenon generated in the multipath type print head.

Furthermore, in the case of the multipath type print head, a trick is applied in such a way that scans by the print head are repeated to prevent the banding phenomenon. However, when any one of pieces of the printing apparatus according to aspects 1 to 8 is adapted, higher speed printing can also be implemented because it is unnecessary to scan the print head at the same portion for many times.

Aspect 11

On the other hand, in order to achieve the first to the third advantages, a printing apparatus control program according to aspect 11 is a printing apparatus control program used to control a printing apparatus which is capable of printing an image on a medium by a print head having a nozzle that is capable of creating two or more types of dots varied in size on a printing medium, the printing apparatus control program including a program used to allow a computer to implement a process including:

acquiring first image data having a plurality of items of pixel data corresponding to an M-ary pixel value ($M \geqq 3$);

setting nozzle use information that sets whether to use a nozzle corresponding to each item of pixel data for each item of the pixel data in the first image data based on stored descriptions of the nozzle information storing module in which the nozzle information is stored that indicates a property of the nozzle;

changing to a minimum concentration value a pixel value of pixel data set not to use a nozzle by the nozzle use information setting module in the first image data, and creating second image data that an original pixel value before changed is distributed to a pixel value of an unprocessed pixel located near that pixel value;

performing an N-ary formation process to create third image data, the process that an M-ary pixel value ($M \geqq 3$) of pixel data in second image data is transformed to an N-ary value ($M > N \geqq 2$);

creating printing data that defines information about dot forming descriptions of the nozzle corresponding to the third image data; and printing the image on the medium by the print head based on the printing data.

With this configuration, the program is read by the computer, the computer performs the process in accordance with the read program, and then an effect and an advantage can be obtained that are equivalent to those of the printing apparatus according to aspect 1.

Moreover, most of all pieces of the printing apparatus currently commercially available in the market such as the ink jet printer has a computer system formed of a central processing unit (CPU), a memory unit (RAM, ROM), an input/output unit, etc. Since the computer system can be used to implement each module by software, the apparatus can implement each module more economically and easily than the case where exclusive hardware is fabricated to implement each module.

Furthermore, the program is partially rewritten to allow easy upgrade because of renewal and improvement of functions.

Aspect 12

Moreover, in the printing apparatus control program of aspect 11, a printing apparatus control program according to aspect 12 wherein:

the nozzle information includes information indicating whether or not a presence of ink discharge deficiency in the nozzle; and the nozzle use information setting module sets a nozzle disused for all pixel data corresponding to the nozzle with the ink discharge deficiency.

With this configuration, the program is read by the computer, the computer performs the process in accordance with the read program, and then an effect and an advantage can be obtained that are equivalent to those of the printing apparatus according to aspect 2.

Aspect 13

Furthermore, in the printing apparatus control program of aspect 11 or 12, a printing apparatus control program according to aspect 13, wherein the nozzle information includes information about a position shift between an actual position of the dot formed by the nozzle and an ideal forming position of that dot.

With this configuration, the program is read by the computer, the computer performs the process in accordance with the read program, and then an effect and an advantage can be obtained that are equivalent to those of the printing apparatus according to aspect 3.

Aspect 14

Moreover, the printing apparatus control program of aspect 13, a printing apparatus control program according to aspect 14, wherein the nozzle use information setting step sets a nozzle disused for part of pixel data corresponding to a nozzle having a position shift greater than a predetermined amount.

With this configuration, the program is read by the computer, the computer performs the process in accordance with the read program, and then an effect and an advantage can be obtained that are equivalent to those of the printing apparatus according to aspect 4.

Aspect 15

Furthermore, in any one of the printing apparatus control programs of aspects 11 to 14, a printing apparatus control program according to aspect 15, wherein in the process that distributes the original pixel value, the second image data creating step distributes the original pixel value before changed to a pixel value of pixel image located near pixel image of that pixel value at a random ratio.

With this configuration, the program is read by the computer, the computer performs the process in accordance with the read program, and then an effect and an advantage can be obtained that are equivalent to those of the printing apparatus according to aspect 5.

Aspect 16

Moreover, in any one of the printing apparatus control programs of aspects 11 to 15, a printing apparatus control program according to aspect 16 wherein:

the nozzle use information setting step creates a nozzle setting information table formed of information that sets whether to use a nozzle corresponding to each item of pixel data for each item of the pixel data in the first image data; and the N-ary formation process step creates the third image data that the second image data is formed in an N-ary form based on the nozzle setting information table.

With this configuration, the program is read by the computer, the computer performs the process in accordance with the read program, and then an effect and an advantage can be obtained that are equivalent to those of the printing apparatus according to aspect 6.

Aspect 17

Furthermore, in any one of the printing apparatus control programs of aspects 11 to 15, a printing apparatus control program according to aspect 17 wherein:

the nozzle use information setting step creates a nozzle setting information table formed of information that sets whether to use a nozzle corresponding to each item of pixel data for each item of the pixel data in the first image data; and the printing data creating step creates the printing data that the third image data is corrected based on the nozzle setting information table.

With this configuration, the program is read by the computer, the computer performs the process in accordance with the read program, and then an effect and an advantage can be obtained that are equivalent to those of the printing apparatus according to aspect 7.

Aspect 18

Moreover, in any one of the printing apparatus control programs of aspects 11 to 15, a printing apparatus control program according to aspect 18 wherein:

the nozzle use information setting step creates a nozzle setting information table formed of information that sets whether to use a nozzle corresponding to each item of pixel data for each item of the pixel data in the first image data; and the printing step prints the image on the medium by the print head based on the printing data and the nozzle setting information table.

With this configuration, the program is read by the computer, the computer performs the process in accordance with the read program, and then an effect and an advantage can be obtained that are equivalent to those of the printing apparatus according to aspect 8.

Aspect 19

On the other hand, in order to achieve the first to the third advantages, a computer readable recording medium stored with a printing apparatus control program according to aspect 19 records any one of the printing apparatus control programs according to aspects 11 to aspect 18.

Accordingly, an effect and an advantage can be obtained as similar to those of any one of the printing apparatus control programs according to aspects 11 to aspect 18, and the printing program can be received and sent easily through the recording medium such as CD-ROM, DVD-ROM, and MO.

Aspect 20

On the other hand, in order to achieve the first to the third advantages, the printing apparatus control method according to aspect 20 is a printing apparatus control method used to control a printing apparatus which is capable of printing an image on a medium by a print head having a nozzle that is capable of creating two or more types of dots varied in size on a printing medium, the printing apparatus control method including:

acquiring first image data having a plurality of items of pixel data corresponding to an M-ary pixel value ($M \geqq 3$);

setting nozzle use information that sets whether to use a nozzle corresponding to each item of pixel data for each item of the pixel data in the first image data based on stored descriptions of the nozzle information storing module in which the nozzle information is stored that indicates a property of the nozzle;

changing to a minimum concentration value a pixel value of pixel data set not to use a nozzle by the nozzle use information setting module in the first image data, and creating second image data that an original pixel value before changed is distributed to a pixel value of an unprocessed pixel located near that pixel value;

performing an N-ary formation process to create third image data, the process that an M-ary pixel value ($M \geqq 3$) of pixel data in second image data is transformed to an N-ary value ($M > N \geqq 2$);

creating printing data that defines information about dot forming descriptions of the nozzle corresponding to the third image data; and printing the image on the medium by the print head based on the printing data.

Accordingly, an effect and advantage can be obtained that are the same as those of the printing apparatus according to aspect 1.

Aspect 21

Furthermore, in the printing apparatus control method of aspect 20, a printing apparatus control method according to aspect 21 wherein:

the nozzle information includes information indicating whether or not a presence of ink discharge deficiency in the nozzle; and the nozzle use information setting module sets the nozzle disused for all pixel data corresponding to the nozzle with the ink discharge deficiency.

Accordingly, an effect and an advantage can be obtained that are equivalent to those of the printing apparatus according to aspect 2.

Aspect 22

Moreover, in the printing apparatus control method of aspect 20 or 21, a printing apparatus control method according to aspect 22, wherein the nozzle information includes information about a position shift between an actual position of the dot formed by the nozzle and an ideal forming position of that dot.

Accordingly, an effect and an advantage can be obtained that are equivalent to those of the printing apparatus according to aspect 3.

Aspect 23

Furthermore, in the printing apparatus control method of aspect 22, a printing apparatus control method according to aspect 23, wherein the nozzle use information setting step sets a nozzle disused for part of pixel data corresponding to a nozzle having a position shift greater than a predetermined amount.

Accordingly, an effect and an advantage can be obtained that are equivalent to those of the printing apparatus according to aspect 4.

Aspect 24

Moreover, in any one of the printing apparatus control methods of aspects 20 to 23, a printing apparatus control method according to aspect 24, wherein in the process that distributes the original pixel value, the second image data creating step distributes the original pixel value before changed to a pixel value of pixel image located near pixel image of that pixel value at a random ratio.

Accordingly, an effect and an advantage can be obtained that are equivalent to those of the printing apparatus according to aspect 5.

Aspect 25

Furthermore, in any one of the printing apparatus control methods of aspects 20 to 24, a printing apparatus control method according to aspect 25 wherein:

the nozzle use information setting step creates a nozzle setting information table formed of information that sets whether to use a nozzle corresponding to each item of pixel data for each item of the pixel data in the first image data; and the N-ary formation process step creates the third image data that the second image data is formed in an N-ary form based on the nozzle setting information table.

Accordingly, an effect and an advantage can be obtained that are equivalent to those of the printing apparatus according to aspect 6.

Aspect 26

Moreover, in any one of the printing apparatus control methods of aspects 20 to 24, a printing apparatus control method according to aspect 26 wherein:

the nozzle use information setting step creates a nozzle setting information table formed of information that sets whether to use a nozzle corresponding to each item of pixel data for each item of the pixel data in the first image data; and the printing data creating step creates the printing data that the third image data is corrected based on the nozzle setting information table.

Accordingly, an effect and an advantage can be obtained that are equivalent to those of the printing apparatus according to aspect 7.

Aspect 27

Furthermore, in any one of the printing apparatus control methods of aspects 20 to 24, a printing apparatus control method according to aspect 27 wherein: the nozzle use information setting step creates a nozzle setting information table formed of information that sets whether to use a nozzle corresponding to each item of pixel data for each item of the pixel data in the first image data; and the printing step prints the image on the medium by the print head based on the printing data and the nozzle setting information table.

Accordingly, an effect and an advantage can be obtained that are equivalent to those of the printing apparatus according to aspect 8.

Aspect 28

On the other hand, in order to achieve the first to the third advantages, a printing data creating apparatus according to aspect 28 is a printing data creating apparatus which creates printing data used in a printing apparatus which is capable of printing an image on a medium by a print head having a nozzle that is capable of creating two or more types of dots varied in size on a printing medium, the printing data creating apparatus including:

a first image data acquiring module that acquires first image data having a plurality of items of pixel data corresponding to an M-ary pixel value ($M \geqq 3$);

a nozzle information storing module that stores nozzle information indicating a property of the nozzle;

a nozzle use information setting module that sets whether to use the nozzle corresponding to each item of pixel data for each item of pixel data of the first image data based on the nozzle information;

a second image data creating module that changes to a minimum concentration value a pixel value of pixel data set not to use a nozzle by the nozzle use information setting module in the first image data, and creates second image data that an original pixel value before changed is distributed to a pixel value of an unprocessed pixel located near that pixel value;

an N-ary formation process module that performs an N-ary formation process to create third image data, the process that an M-ary pixel value ($M \geqq 3$) of pixel data in second image data is transformed to an N-ary value ($M > N \geqq 2$); and a printing data creating module that creates printing data that defines information about dot forming descriptions of the nozzle corresponding to the third image data.

More specifically, this aspect does not include the printing module that actually implements printing as the printing apparatus, but it creates printing data in accordance with the properties of the print head based on the original M-ary image data.

Therefore, it can obtain an effect and an advantage the same as those of the printing apparatus according to aspect 1. Also, for example, this configuration is feasible that printing data created in this aspect is only sent to the printing apparatus to implement a printing process in the printing apparatus. With this configuration, the existing printing apparatus of the ink jet printing method can be used as it is without preparing an exclusive printing apparatus.

Moreover, since a general-purpose information processor such as a personal computer can be used, the existing printing system formed of a print instructing unit such as a personal computer and the ink jet printer can be utilized as it is.

Aspect 29

Furthermore, in printing data creating apparatus of aspect 28, a printing data creating apparatus according to aspect 29 wherein:

the nozzle information includes information indicating whether or not a presence of ink discharge deficiency in the nozzle; and the nozzle use information setting module sets the nozzle disused for all pixel data corresponding to the nozzle with the ink discharge deficiency.

Accordingly, an effect and an advantage can be obtained that are similar to those of the printing apparatus according to aspect 2.

Aspect 30

Moreover, in printing data creating apparatus of aspect 28 or 29, a printing data creating apparatus according to aspect 30, wherein the nozzle information includes information about a position shift between an actual position of the dot formed by the nozzle and an ideal forming position of that dot.

Accordingly, an effect and an advantage can be obtained that are similar to those of the printing apparatus according to aspect 3.

Aspect 31

Furthermore, in the printing data creating apparatus of aspect 30, a printing data creating apparatus according to aspect 31, wherein the nozzle use information setting module sets a nozzle disused for part of pixel data corresponding to a nozzle having a position shift greater than a predetermined amount.

Accordingly, an effect and an advantage can be obtained that are similar to those of the printing apparatus according to aspect 4.

Aspect 32

Moreover, in any one of pieces of the printing data creating apparatus of aspects 28 to 31, a printing data creating apparatus according to aspect 32, wherein in the process that distributes the original pixel value, the second image data creating module distributes the original pixel value before changed to a pixel value of pixel image located near pixel image of that pixel value at a random ratio.

Accordingly, an effect and an advantage can be obtained that are similar to those of the printing apparatus according to aspect 5.

Aspect 33

Furthermore, in any one of pieces of the printing data creating apparatus of aspects 28 to 32, a printing data creating apparatus according to aspect 33 wherein:

the nozzle use information setting module creates a nozzle setting information table formed of information that sets whether to use a nozzle corresponding to each item of pixel data for each item of the pixel data in the first image data; and the N-ary formation process module creates the third image data that the second image data is formed in an N-ary form based on the nozzle setting information table.

Accordingly, an effect and an advantage can be obtained that are similar to those of the printing apparatus according to aspect 6.

Aspect 34

Moreover, in any one of pieces of the printing data creating apparatus of aspects 28 to 32, a printing data creating apparatus according to aspect 34 wherein:

the nozzle use information setting module creates a nozzle setting information table formed of information that sets whether to use a nozzle corresponding to each item of pixel data for each item of the pixel data in the first image data; and the printing data creating module creates the printing data that the third image data is corrected based on the nozzle setting information table.

Accordingly, an effect and an advantage can be obtained that are similar to those of the printing apparatus according to aspect 7.

Aspect 35

Furthermore, in any one of pieces of the printing data creating apparatus of aspects 28 to 32, a printing data creating apparatus according to aspect 35 wherein:

the nozzle use information setting module creates a nozzle setting information table formed of information that sets whether to use a nozzle corresponding to each item of pixel data for each item of the pixel data in the first image data; and the printing module prints the image on the medium by the print head based on the printing data and the nozzle setting information table.

Accordingly, an effect and an advantage can be obtained that are similar to those of the printing apparatus according to aspect 8.

Aspect 36

On the other hand, in order to achieve the first to the third advantages, a printing data creating program according to aspect 36 is a printing data creating program which creates printing data used in a printing apparatus which is capable of printing an image on a medium by a print head having a nozzle that is capable of creating two or more types of dots varied in size on a printing medium, the printing data creating program including a program used to allow a computer to implement a process including:

acquiring first image data having a plurality of items of pixel data corresponding to an M-ary pixel value ($M \geqq 3$);

setting nozzle use information that sets whether to use a nozzle corresponding to each item of pixel data for each item of the pixel data in the first image data based on nozzle information indicating a property of the nozzle;

changing to a minimum concentration value a pixel value of pixel data set not to use a nozzle by the nozzle use information setting module in the first image data, and creating second image data that an original pixel value before changed is distributed to a pixel value of an unprocessed pixel located near that pixel value;

performing an N-ary formation process to create third image data, the process that an M-ary pixel value ($M \geqq 3$) of pixel data in second image data is transformed to an N-ary value ($M > N \geqq 2$); and creating printing data that defines information about dot forming descriptions of the nozzle corresponding to the third image data.

With this configuration, the program is read by the computer, the computer performs the process in accordance with the read program, and then an effect and an advantage can be obtained that are equivalent to those of the printing data creating apparatus according to aspect 28.

Aspect 37

Moreover, in the printing data creating program of aspect 36, a printing data creating program according to aspect 37 wherein:

the nozzle information includes information indicating whether or not a presence of ink discharge deficiency in the nozzle; and the nozzle use information setting step sets the nozzle disused for all pixel data corresponding to the nozzle with the ink discharge deficiency.

With this configuration, the program is read by the computer, the computer performs the process in accordance with the read program, and then an effect and an advantage can be obtained that are equivalent to those of the printing data creating apparatus according to aspect 28.

Aspect 38

Furthermore, in the printing data creating program of aspect 36 or 37, a printing data creating program according to aspect 38, wherein the nozzle information includes information about a position shift between an actual position of the dot formed by the nozzle and an ideal forming position of that dot.

With this configuration, the program is read by the computer, the computer performs the process in accordance with the read program, and then an effect and an advantage can be obtained that are equivalent to those of the printing data creating apparatus according to aspect 30.

Aspect 39

Moreover, in the printing data creating program of aspect 38, a printing data creating program according to aspect 39, wherein the nozzle use information setting step sets a nozzle disused for part of pixel data corresponding to a nozzle having a position shift greater than a predetermined amount.

With this configuration, the program is read by the computer, the computer performs the process in accordance with the read program, and then an effect and an advantage can be obtained that are equivalent to those of the printing data creating apparatus according to aspect 31.

Aspect 40

Furthermore, in any one of the printing data creating programs of aspects 36 to 39, a printing data creating program according to aspect 40, wherein in the process that distributes the original pixel value, the second image data creating step distributes the original pixel value before changed to a pixel value of pixel image located near pixel image of that pixel value at a random ratio.

With this configuration, the program is read by the computer, the computer performs the process in accordance with the read program, and then an effect and an advantage can be obtained that are equivalent to those of the printing data creating apparatus according to aspect 31.

Aspect 41

Moreover, in any one of the printing data creating programs of aspects 36 to 40, a printing data creating program according to aspect 41 wherein:

the nozzle use information setting step creates a nozzle setting information table formed of information that sets whether to use a nozzle corresponding to each item of pixel data for each item of the pixel data in the first image data; and the N-ary formation process step creates the third image data that the second image data is formed in an N-ary form based on the nozzle setting information table.

With this configuration, the program is read by the computer, the computer performs the process in accordance with the read program, and then an effect and an advantage can be obtained that are equivalent to those of the printing data creating apparatus according to aspect 33.

Aspect 42

Furthermore, in any one of the printing data creating programs of aspects 36 to 40, a printing data creating program according to aspect 42 wherein:

the nozzle use information setting module creates a nozzle setting information table formed of information that sets whether to use a nozzle corresponding to each item of pixel data for each item of the pixel data in the first image data; and the printing data creating module creates the printing data that the third image data is corrected based on the nozzle setting information table.

With this configuration, the program is read by the computer, the computer performs the process in accordance with the read program, and then an effect and an advantage can be obtained that are equivalent to those of the printing data creating apparatus according to aspect 27.

Aspect 43

On the other hand, in order to achieve the first to the third advantages, a computer readable recording medium recorded with a printing data creating program according to aspect 43 records any one of the printing data creating programs according to aspects 36 to 42.

Accordingly, an effect and an advantage can be obtained that are similar to those of any one of printing data creating programs according to aspects 35 to 41, and the printing program can be received and sent easily through the recording medium such as CD-ROM, DVD-ROM, and FD (flexible disk).

Aspect 44

On the other hand, in order to achieve the first to the third advantages, a printing data creating method according to aspect 44 is a printing data creating method which creates printing data used in a printing apparatus which is capable of printing an image on a medium by a print head having a nozzle that is capable of creating two or more types of dots varied in size on a printing medium, the printing data creating method including:

acquiring first image data having a plurality of items of pixel data corresponding to an M-ary pixel value ($M \geqq 3$);

setting nozzle use information that sets whether to use a nozzle corresponding to each item of pixel data for each item of the pixel data in the first image data based on nozzle information indicating a property of the nozzle;

changing to a minimum concentration value a pixel value of pixel data set not to use a nozzle by the nozzle use information setting module in the first image data, and creating second image data that an original pixel value before changed is distributed to a pixel value of an unprocessed pixel located near that pixel value;

performing an N-ary formation process to create third image data, the process that an M-ary pixel value ($M \geqq 3$) of pixel data in second image data is transformed to an N-ary value ($M > N \geqq 2$); and creating printing data that defines information about dot forming descriptions of the nozzle corresponding to the third image data.

Accordingly, an effect and an advantage can be obtained that are equivalent to those of the printing data creating apparatus according to aspect 28.

Aspect 45

Moreover, the printing data creating method of aspect 44, in a printing data creating method according to aspect 45 wherein:

the nozzle information includes information indicating whether or not a presence of ink discharge deficiency in the nozzle; and the nozzle use information setting module sets the nozzle disused for all pixel data corresponding to the nozzle with the ink discharge deficiency.

Accordingly, an effect and an advantage can be obtained that are equivalent to those of the printing data creating apparatus according to aspect 29.

Aspect 46

Furthermore, in the printing data creating method of aspect 44 or 45, a printing data creating method according to aspect 46, wherein the nozzle information includes information about a position shift between an actual position of the dot formed by the nozzle and an ideal forming position of that dot.

Accordingly, an effect and an advantage can be obtained that are equivalent to those of the printing data creating apparatus according to aspect 30.

Aspect 47

Moreover, in the printing data creating method of aspect 46, a printing data creating step according to aspect 47, wherein the nozzle use information setting module sets a nozzle disused for part of pixel data corresponding to a nozzle having a position shift greater than a predetermined amount.

Accordingly, an effect and an advantage can be obtained that are equivalent to those of the printing data creating apparatus according to aspect 31.

Aspect 48

Furthermore, in any one of printing data creating method of aspects 44 to 47, a printing data creating method according to aspect 48, wherein in the process that distributes the original pixel value, the second image data creating step distributes the original pixel value before changed to a pixel value of pixel image located near pixel image of that pixel value at a random ratio.

Accordingly, an effect and an advantage can be obtained that are equivalent to those of the printing data creating apparatus according to aspect 32.

Aspect 49

Moreover, in any one of printing data creating method of aspects 44 to 48, a printing data creating method according to aspect 49 wherein:

the nozzle use information setting step creates a nozzle setting information table formed of information that sets whether to use a nozzle corresponding to each item of pixel data for each item of the pixel data in the first image data; and the N-ary formation process step creates the third image data that the second image data is formed in an N-ary form based on the nozzle setting information table.

Accordingly, an effect and an advantage can be obtained that are equivalent to those of the printing data creating apparatus according to aspect 33.

Aspect 50

Furthermore, in any one of printing data creating method of aspects 44 to 48, a printing data creating method according to aspect 50 wherein:

the nozzle use information setting step creates a nozzle setting information table formed of information that sets whether to use a nozzle corresponding to each item of pixel data for each item of the pixel data in the first image data; and the printing data creating step creates the printing data that the third image data is corrected based on the nozzle setting information table.

Accordingly, an effect and an advantage can be obtained that are equivalent to those of the printing data creating apparatus according to aspect 34.

Aspect 51

On the other hand, in order to achieve the first to the third advantages, a nozzle setting information table creating method according to aspect 51 is a nozzle setting information table creating method which creates a nozzle setting information table used in a printing apparatus which is capable of printing an image on a medium by a print head having a nozzle that is capable of creating two or more types of dots varied in size on a printing medium based on printing data created from image data that is corrected by using a pixel value of pixel data that the nozzle is set disused, the nozzle setting information table creating method including:

acquiring first image data having a plurality of items of pixel data corresponding to an M-ary pixel value ($M \geqq 3$);

setting nozzle use information that sets whether to use a nozzle corresponding to each item of pixel data for each item of pixel data acquired at the image data acquiring step based on nozzle information indicating a property of the nozzle; and creating a nozzle setting information table that sets whether to use a nozzle corresponding to each item of pixel data of the image data based on setting information at the nozzle use information setting step.

Therefore, the nozzle setting information table can be created that sets a nozzle corresponding to pixel data disused for part or all of that pixel data, for example, for pixel data relating to the 'banding phenomenon' caused by the nozzle properties generated from ink discharge deficiency in the nozzle and from 'the curved flight phenomenon' in the nozzle that the dot forming position is shifted from an ideal position. Therefore, the table is used to correct image data or control the printing process, and thus an advantage can be obtained that can properly reduce the degradation of printed image quality such as 'white streaks' and 'thick streaks' caused by the banding phenomenon.

Aspect 52

Moreover, in the nozzle setting information table creating method of aspect 51, a nozzle setting information table creating method according to aspect 52 wherein:

the nozzle information includes information indicating whether or not a presence of ink discharge deficiency in the nozzle; and the nozzle use information setting module sets the nozzle disused for all pixel data corresponding to the nozzle with the ink discharge deficiency.

Therefore, the nozzle setting information table can be created that sets a nozzle disused for all pixel data corresponding to that nozzle having ink discharge deficiency such as the nozzle that cannot discharge ink, has a shorter ink discharge amount, and has a greater ink discharge amount. Thus, for example, an advantage can be obtained that when pixel data that the nozzle is set used corresponds to the nozzle that cannot discharge ink, the pixel value can be prevented from not being corrected by other pixels near that pixel.

Aspect 53

Besides, in the nozzle setting information table creating method of aspect 51 or 52, a nozzle setting information table creating method according to aspect 53, wherein the nozzle information includes information about a position shift between an actual position of the dot formed by the nozzle and an ideal forming position of that dot.

Therefore, the nozzle setting information table can be created that properly sets whether to use the nozzle for pixel data corresponding to a nozzle that might cause a so-called 'curved flight phenomenon' generated by shifting the dot forming position from an ideal forming position. Also, the number of items of pixel data that is set disused in the nozzle setting information table can be varied in accordance with the magnitude of an amount of curved flight. Thus, an advantage can be obtained that the nozzle setting information table can be created suitable for preventing the 'banding phenomenon' caused by 'the curved flight phenomenon'.

BRIEF DESCRIPTION OF THE DRAWINGS

The invention will be described with reference to the accompanying drawings, wherein like numbers reference like elements.

FIG. 10A is a diagram illustrating the presence of ink discharge deficiency (in the drawing, no ink discharge) to each of nozzles, and FIG. 10B is a diagram illustrating relative discharge accuracy information (an amount of curved flight information) to each of the nozzles.

FIG. 11A is a diagram illustrating a setting information table for discharge/no discharge (use/disuse) to a relative amount x of curved flight, and FIG. 11B is a diagram illustrating exemplary setting information when discharge/no discharge (use/disuse) is set.

FIG. 12 is a diagram illustrating an example that nozzles are set discharged/not discharged (used/disused) based on the setting information table shown in FIG. 10.

FIG. 13 is a diagram illustrating an example that nozzles are set discharged/not discharged (used/disused) when a particular curved flight state is generated.

FIG. 14 is a diagram illustrating an exemplary nozzle setting information table.

DESCRIPTION OF EXEMPLARY EMBODIMENTS

First Embodiment

Hereinafter, a first embodiment according to the invention will be described with reference to the drawings. FIGS. 1 to 18 are diagrams illustrating a first embodiment of a printing apparatus, a printing apparatus control program, a printing apparatus control method, a printing data creating apparatus, a printing data creating program, and a printing data creating method according to the invention.

Figure 1:
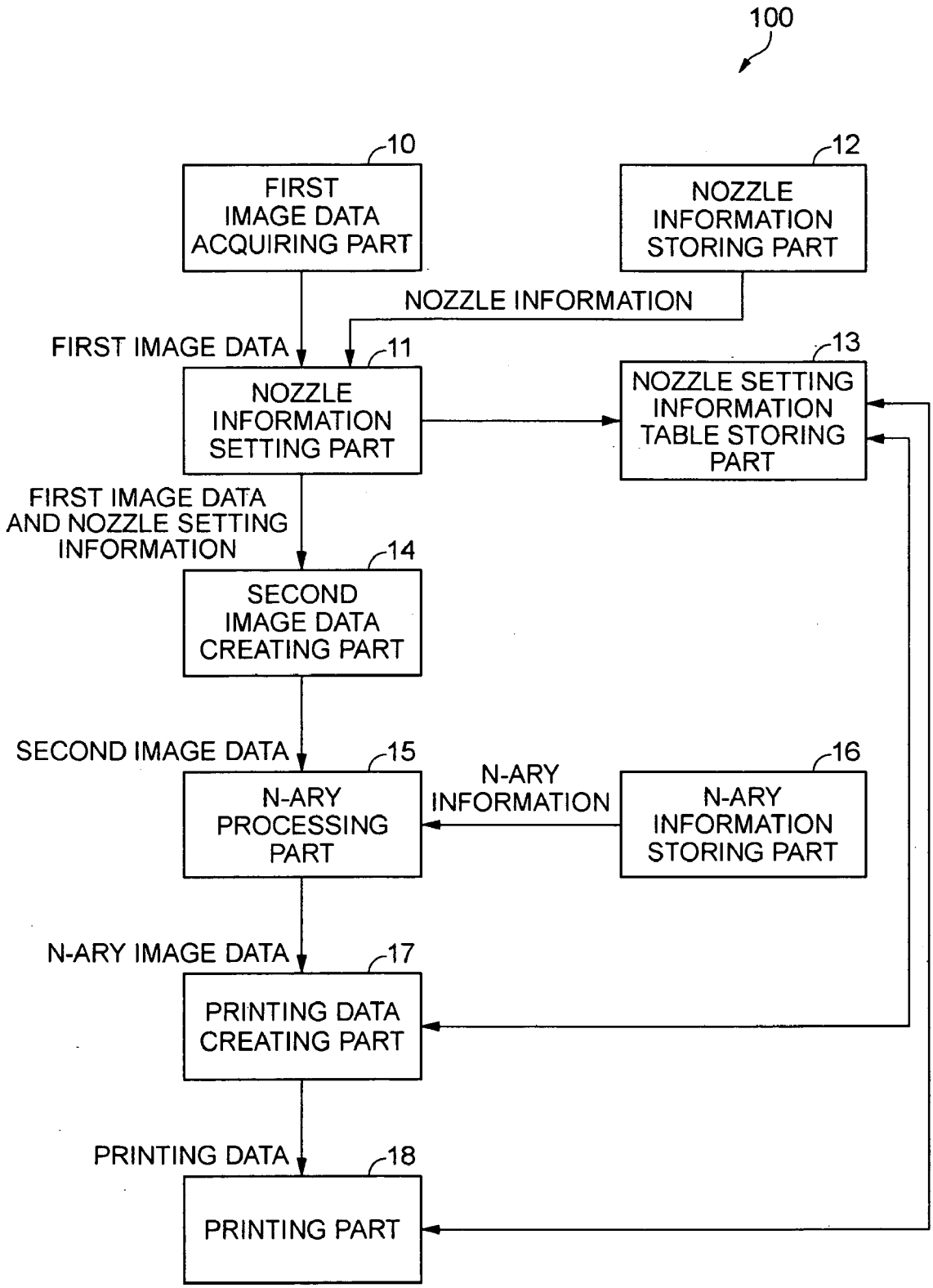
FIG. 1 is a block diagram illustrating the configuration of a printing apparatus 100 according to the invention.

First, the configuration of a printing apparatus 100 according to the invention will be described with reference to FIG. 1. FIG. 1 is a block diagram illustrating the configuration of the printing apparatus 100 according to the invention.

The printing apparatus 100 is a line scan head type printing apparatus. As shown in FIG. 1, the apparatus is configured to include a first image data acquiring part 10 which acquires M-ary first image data ($M \geqq 3$) from an external unit or a storage medium; a nozzle information setting part 11 which creates a nozzle setting information table to set whether to use a nozzle for each item of pixel data of first image data acquired from the first image data acquiring part 10 based on nozzle information stored in a nozzle information storing part 12, described later; the nozzle information storing part 12 which stores nozzle information indicating the properties of each of nozzles N in a print head 200, described later; a nozzle setting information table storing part 13 which stores the nozzle setting information table created at the nozzle information setting part 11; and a second image data creating part 14 which changes to the minimum concentration value the pixel value of pixel data that a nozzle is set disused in each item of pixel data of first image data based on the nozzle setting information table created at the nozzle information setting part 11, and creates second image data that the pixel value before changed is distributed to surrounding pixels.

For example, the first image data acquiring part 10 has a function that acquires M-ary image data (in this case, $256 \geqq M \geqq 3$) that the gray scale (brightness value) for each color (R, G, B) per pixel is expressed by eight bits (0 to 255). It acquires this image data from an external unit through a network such as LAN and WAN, from a recording medium such as CD-ROM and DVD-ROM through a drive unit such as a CD drive and a DVD drive held by that apparatus, not shown, and from a memory unit 70 held by that apparatus, described later. Furthermore, it also exerts a function that color converts M-ary RGB data and converts it to M-ary CMYK data (when four colors) corresponding to each ink of the print head 200.

The nozzle information setting part 11 sets whether to use a nozzle corresponding to each item of pixel data for each item of pixel data forming first image data (hereinafter, it is called CMYK image data) that is converted to CMYK data based on nozzle information stored in the nozzle information storing part 12, it creates the nozzle setting information table from the set result, and it sends the generated nozzle setting information table to the second image data creating part 14 along with CMYK image data. Moreover, it stores the nozzle setting information table in the nozzle setting information table storing part 13.

The nozzle information storing part 12 stores nozzle information including information that indicates the properties of the nozzles N such as information that indicates the correspondence between each of the nozzles N in the print head 200 held by a printing part 18 and each item of pixel data in image data, information that indicates whether or not a presence of ink discharge deficiency in each of the nozzles N, and information that indicates an amount of curved flight of each of the nozzles N.

Therefore, the nozzle information setting part 11 can set whether to use a nozzle for each item of pixel data in first image data in accordance with a no ink discharge state of the nozzle and the magnitude of an amount of curved flight.

The nozzle setting information table storing part 13 stores the nozzle setting information table created at the nozzle information setting part 11.

Here, the nozzle setting information table is a table that sets whether to use a nozzle N corresponding to each item of pixel data for each item of pixel data in first image data.

The second image data creating part 14 acquires first image data and the nozzle setting information table from the nozzle information setting part 11. It creates second image data from first image data in which based on the acquired nozzle setting information table, it changes the pixel value of pixel data that the nozzle is set disused in first image data to the minimum concentration value (when the pixel value is the concentration value, it is set to '0', and when the pixel value is the brightness value, it is set to 'the maximum brightness value (for example, 255, etc.)') as well as distributes the original pixel value before changed to pixels that surround the pixel set disused. Furthermore, it transmits created second image data to an N-ary formation processing part 15.

Moreover, as shown in FIG. 1, the printing apparatus 100 is configured to include the N-ary formation processing part 15 which performs an N-ary formation process (M>N≧2) for second image data created at the second image data creating part 14 based on N-ary information stored in an N-ary information storing part 16, a printing data creating part 17 which creates printing data for printing an image of second image data on a printing medium (for example, printing paper) at the printing part 18, described later, based on second image data after the N-ary formation process, and the printing part 18 which prints the image of second image data on the printing medium by the ink jet printing method based on printing data.

The N-ary formation processing part 15 selects predetermined pixel data from second image data acquired from the second image data creating part 14. It uses an error spread scheme to make the selected predetermined pixel data (hereinafter, it is called selected pixel data) to an N-ary form based on an N-ary threshold corresponding to the dot forming size of the nozzle, the dot number corresponding to each dot forming size and on the pixel value after N-ary formation (for example, the brightness value) corresponding to each dot number, which are included in N-ary information read out of the N-ary information storing part 16. More specifically, the N-ary formation processing part 15 forms selected pixel data into an N-ary form, and computes the differential of that pixel data between the pixel values before and after N-ary formation. It considers the differential as an error, and spreads it to pixel data that does not undergo the N-ary formation process around pixels corresponding to the selected pixel data.

As described above, N-ary formation and the error spread process are applied to all the pixel data of second image data to transform it to data formed of the brightness value and nozzle number information in accordance with N types of dot forming size that each of the nozzles of the print head 200 can generate. Hereinafter, second image data after N-ary formation and the error spread process is called N-ary image data.

Here, N-ary formation is a process that M-ary image data (M≧3) (having M types of pixel values (pixel data)) is transformed to N-ary data (M>N≧2) (having N types of numerics). For example, in the case of binarization, the pixel value to be transformed is transformed to any one of two types of numerics set beforehand in such a way that the pixel value to be transformed is compared with the threshold, and it is transformed to numeric '1' when it is equal to or greater than the threshold value, whereas it is transformed to numeric '0' when it is smaller than the threshold value. Therefore, in the case of N-ary formation, an M-ary pixel value is compared with N types of thresholds, and the pixel value is transformed to any one of N types of numerics set beforehand in accordance with the compared result.

Furthermore, the error spread scheme is to spread errors by the same principles as publicly-known error spread schemes. For example, in the case of binarization where the N-ary image data is transformed to '0' when the pixel value is smaller than '128' and to '255' when it is equal to or greater than '128' bordering at the threshold value of '128', when the pixel value of the selected pixel is '101', '101' is transformed to '0', the difference '101' between '0' after transformed and '101' before transformed is considered as an error, and the error is spread to a plurality of unprocessed pixels therearound in accordance with a predetermined spread scheme. For example, a pixel (for example, the pixel value '101') on the right side of the selected pixel does not satisfy the threshold only by a normal binarization process as similar to the selected pixel, and thus it is transformed to '0'. When it receives '27', for example, which is an error of the selected pixel, its pixel value is '128' to be equal to or greater than the threshold '128', and therefore it is transformed to '1'.

As described above, the N-ary information storing part 16 stores N-ary information including the N-ary threshold corresponding to the dot forming size of the nozzle, the dot number corresponding to each dot forming size, and the pixel value after N-ary formation (for example, the brightness value) corresponding to each dot number.

The printing data creating part 17 outputs N-ary image data formed of nozzle number information (0 to 7) as printing data to the printing part 18. It also creates printing data that corrects to nozzle number 0 (no dots are formed) a portion where the nozzle is set disused in the table and the dot number to form dots is set in N-ary image data based on the nozzle setting information table stored in the nozzle setting information table storing part 13 in accordance with user.

Figure 3:
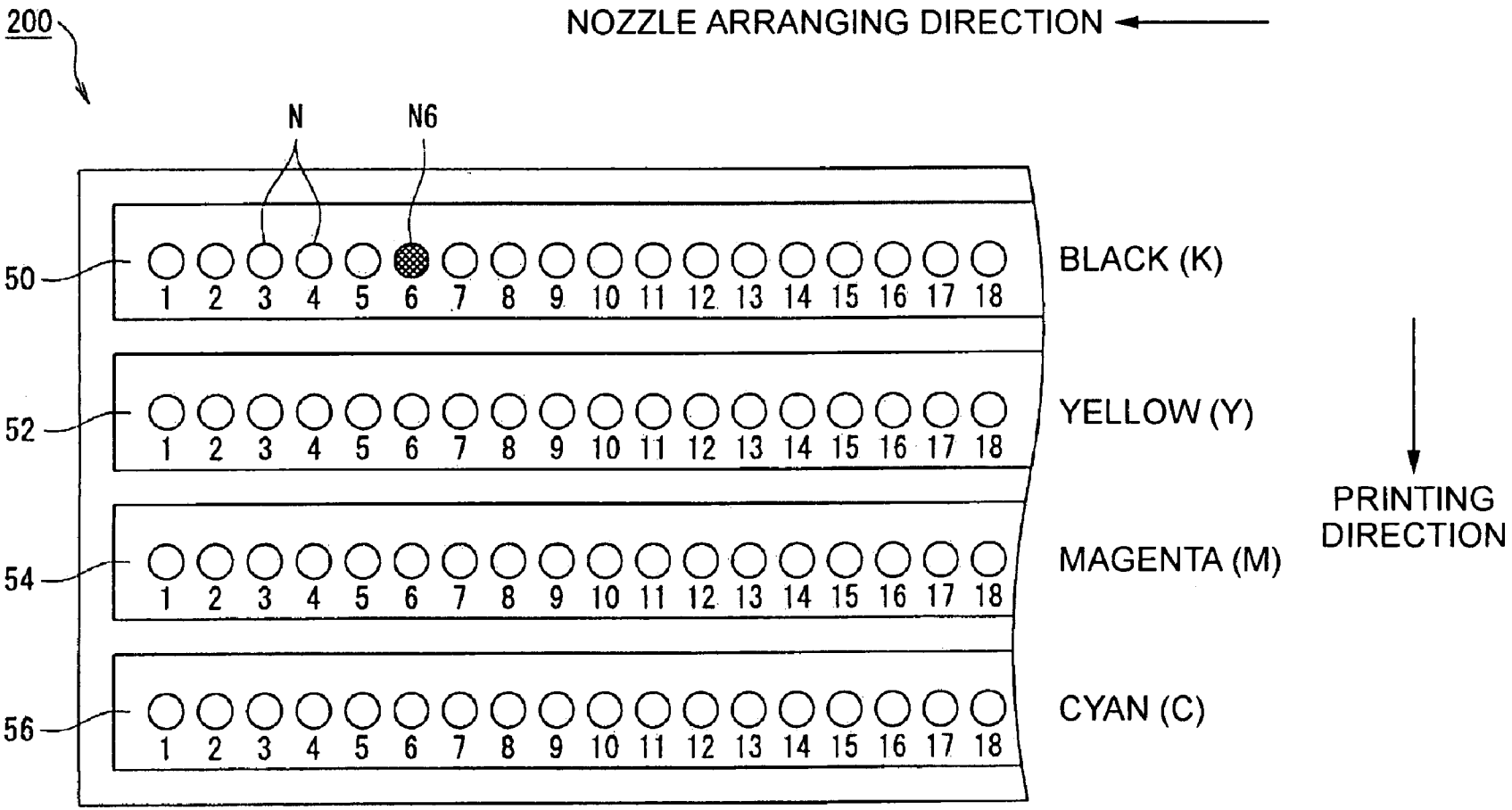
FIG. 3 is a partially enlarged bottom view illustrating the structure of a print head 200 according to the invention.
Figure 4:
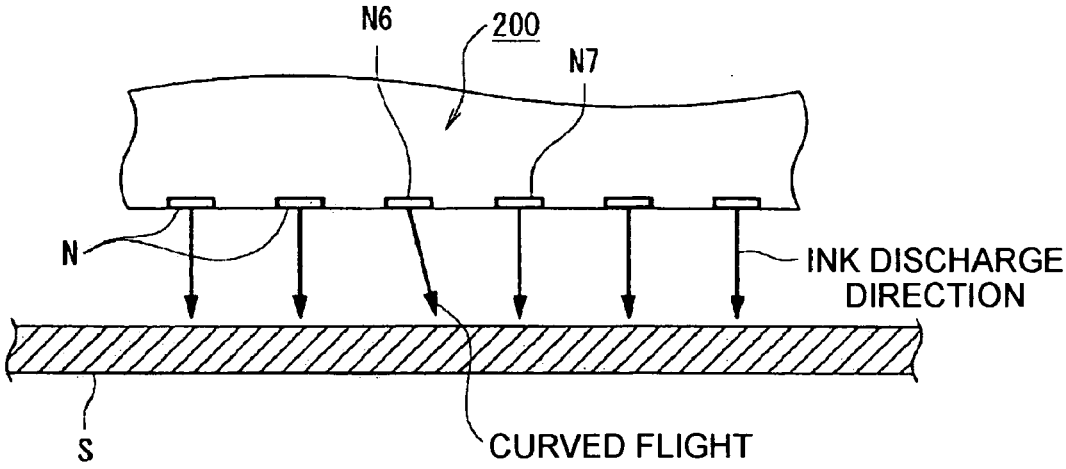
FIG. 4 is a partially enlarged side view of FIG. 4.

Here, FIG. 3 is a partially enlarged bottom view illustrating the structure of the print head 200 according to the invention, and FIG. 4 is a partially enlarged side view thereof.

As shown in FIG. 3, the print head 200 is configured to include four nozzle modules 50, 52, 54 and 56: the black nozzle module 50 having a plurality of nozzles N (18 nozzles in the drawing)) exclusively discharging black (K) ink linearly arranged in the nozzle arranging direction, the yellow nozzle module 52 having a plurality of nozzles N exclusively discharging yellow (Y) ink similarly linearly arranged in the nozzle arranging direction, the magenta nozzle module 54 having a plurality of nozzles N exclusively discharging magenta (M) ink similarly linearly arranged in the nozzle arranging direction, and the cyan nozzle module 56 having a plurality of nozzles N exclusively discharging cyan (M) ink similarly linearly arranged in the nozzle arranging direction. Then, the nozzle modules 50, 52, 54 and 56 are configured to be arranged integrally so that each of the nozzles N with the same number in these four nozzle modules is linearly arranged in the printing direction (the direction vertical to the nozzle arranging direction) as shown in FIG. 3. Thus, a plurality of the nozzles N that configure each of the nozzle modules is linearly arranged in the nozzle arranging direction, and each of the nozzles N with the same number in these four nozzle modules is linearly arranged in the printing direction.

Moreover, FIG. 4 depicts the state that the sixth nozzle N6 from left of the black nozzle module 50 among the four nozzle modules 50, 52, 54 and 56 has the curved flight phenomenon in which ink is discharged from the nozzle N6 onto printing medium S in the oblique direction, and thus a dot is formed on the printing medium S at the position near a dot discharged from normal nozzle N7 adjacent to the nozzle N6 and formed on the printing medium S.

Returning to FIG. 1, the printing part 18 is a printer of the ink jet printing method in which ink is injected in dots from the nozzle modules 50, 52, 54 and 56 formed in the print head 200 onto the printing medium S to form an image formed of multiple dots while one or both of the printing medium S and the print head 200 shown in FIG. 4 are moving. In addition to the print head 200 described above, it is configured of a print head feed mechanism (in the case of the multipath type), not shown, which reciprocates the print head 200 over the printing medium S in the width direction, a paper feed mechanism, not shown, which moves the printing medium (paper) S, a print control mechanism, not shown, which controls ink discharge in the print head 200 based on the printing data described above, etc.

Figure 2:
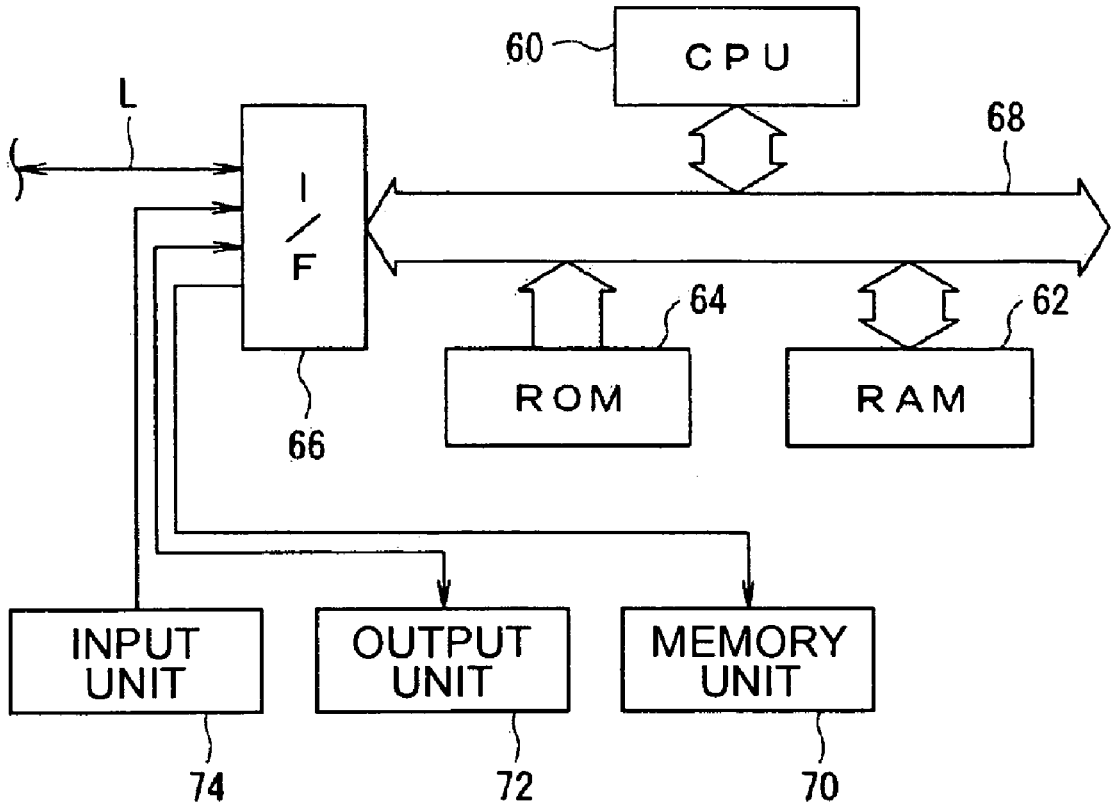
FIG. 2 is a diagram illustrating the hardware configuration of a computer system.

In addition, the printing apparatus 100 has a computer system which implements each function described above on software in the first the first image data acquiring part 10, the nozzle information setting part 11, the second image data creating part 14, the N-ary formation processing part 15, the printing data creating part 16, the printing part 18, etc., and runs software to control hardware necessary to implement each function. As shown in FIG. 2, the hardware configuration of the computer system has a CPU (Central Processing Unit) 60 which is a central processor that conducts various control and computing processes, RAM (Random Access Memory) 62 which configures a main storage, ROM (Read Only Memory) 64 which is a read-only memory unit, and various internal and external buses 68 formed of PCI (Peripheral Component Interconnect) bus, ISA (Industrial standard Architecture) bus, etc., which connect the devices above. To the buses 68, an external a (Secondary storage) 70 such as HDD, the printing part 18, an output unit 72 such as CRT and a LCD monitor, an input unit 74 such as an operation panel, a mouse, a keyboard, and a scanner, and a network cable L which communicates with a print instructing unit, not shown, are connected through an input/output interface (I/F) 66.

Then, when the power is turned on, a system program such as BIOS stored in the ROM 64 loads to the RAM 62 various exclusive computer programs stored in the ROM 64 beforehand and various exclusive computer programs installed in the memory unit 70 through a storage medium such as CD-ROM, DVD-ROM, and a flexible disk (FD), or through a communication network such as the Internet. In accordance with instructions described in the programs loaded in the RAM 62, the CPU 60 uses various resources to conduct predetermined control and computing processes to implement each function described above on software.

Figure 5:
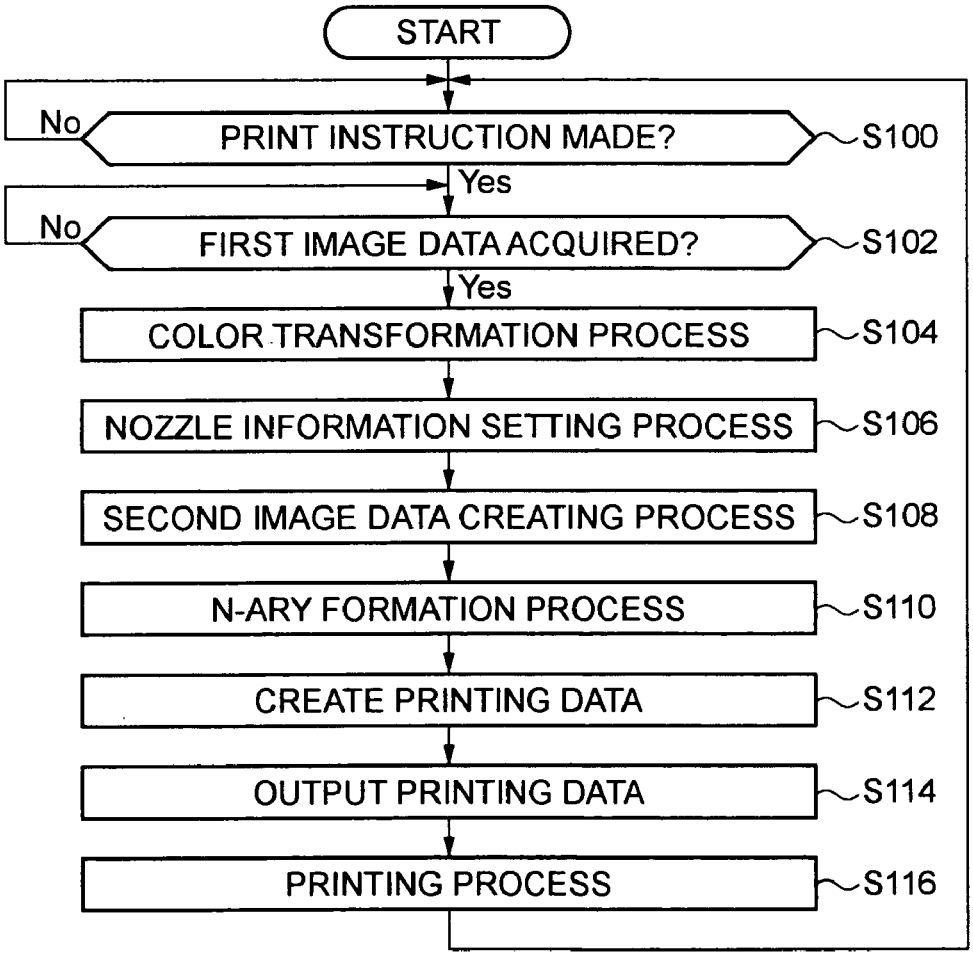
FIG. 5 is a flow chart illustrating a printing process in the printing apparatus 100.

Furthermore, the printing apparatus 100 permits the CPU 60 to activate a predetermined program stored in a predetermined area in the ROM 64 to run a printing process shown in a flow chart in FIG. 5 in accordance with that program. In addition, as described above, the print head 200 which generates dots can form multiple colors of dots in generally four colors and six colors nearly at the same time. However, in the examples below, in convenience for easy explanation, a dot is described as it is generated by a single color print head 200 (monochrome image).

FIG. 5 is a flow chart illustrating a printing process in the printing apparatus 100.

As shown in FIG. 5, when the CPU 60 runs the printing process, it moves to Step S100.

At Step S100, at the first image data acquiring part 10, print instruction information is sent from the external unit connected through the network cable L, or print instruction information is inputted through the input unit 74 to determine whether a print instruction is made. When it is determined that the print instruction is made (Yes), the process moves to Step S102, otherwise (No) the determination process is repeated until the print instruction is made.

When the process moves to Step S102, at the first image data acquiring part 10, first image data corresponding to the print instruction is acquired from the external unit, the recording medium such as CD-ROM, DVD-ROM, and memory unit 70 such as HDD as described above.

Thus, it is determined whether first image data is acquired. When it is determined that first image data is acquired (Yes), the process moves to Step S104, otherwise (No) a response is made to a source print instruction that printing is not allowed, and then the printing process for that print instruction is cancelled, moving to Step S100. Here, first image data is data that is configured to arrange a plurality of items of M-ary pixel data in a matrix. Its row direction is matched with the nozzle arranging direction of the print head 200, and its column direction is matched with the printing direction of the print head 200.

When the process moves to Step S104, at the first image data acquiring part 10, when M-ary image data acquired at Step S102 is image data having color information other than CMYK, that image data is transformed to CMYK image data having CMYK color information and that CMYK image data is transmitted to the nozzle information setting part 11, moving to Step S106. More specifically, image data having color information other than CMYK is CMYK transformed and then transmitted. On the other hand, CMYK image data is transmitted as it is.

At Step S106, at the nozzle information setting part 11, when CMYK image data is acquired from the first image data acquiring part 10, a nozzle information setting process is run to create a nozzle setting information table, CMYK image data is transmitted to the second image data creating part 14 along with the generated nozzle setting information table, moving to Step S108.

At Step S108, at the second image data creating part 14, when CMYK image data and the nozzle setting information table are acquired from the nozzle information setting part 11, a second image data creating process is run to create second image data, and the generated second image data is transmitted to the N-ary formation processing part 15, moving to Step S110.

At Step S110, at the N-ary formation processing part 15, when second image data is acquired from the second image data creating part 14, the N-ary formation process is run for the acquired second image data to create N-ary image data, and the generated N-ary image data is transmitted to the printing data creating part 17, moving to Step S112.

At Step S112, at the printing data creating part 17, when N-ary image data is acquired from the N-ary formation processing part 15, printing data is created from N-ary image data, moving to Step S114. Here, the printing data creating part 17 has a function that creates printing data that second image data after the N-ary formation process is corrected in accordance with the user's correction instruction or correction setting.

At Step S114, at the printing data creating part 17, printing data created at Step S112 is outputted to the printing part 18, moving to Step S116.

At Step S116, at the printing part 18, a printing process is run based on printing data from the printing data creating part 17, moving to Step S100.

Next, with reference to FIG. 6, the nozzle information setting process at Step S106 will be described in detail.

Figure 6:
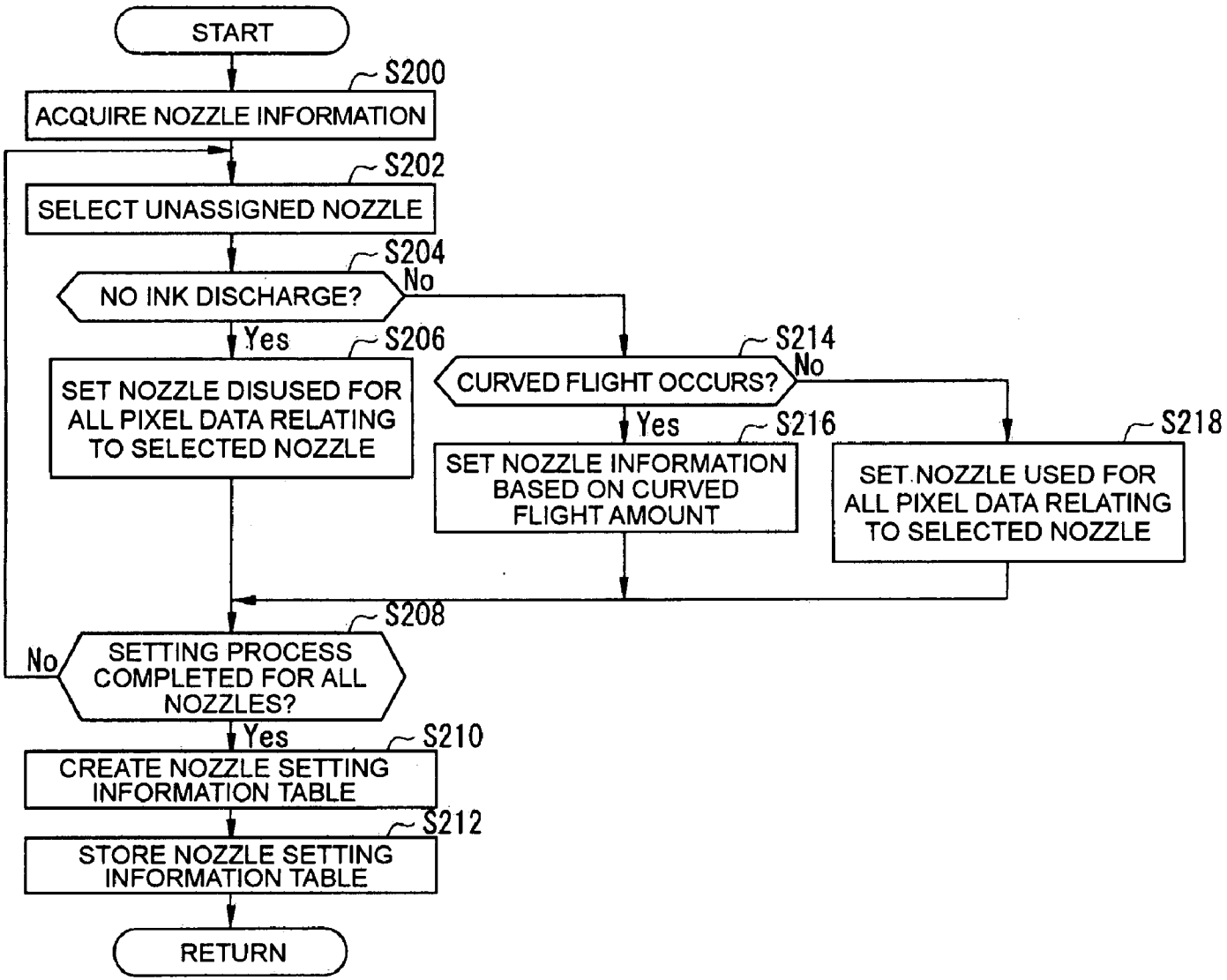
FIG. 6 is a flow chart illustrating a nozzle information setting process in the printing apparatus 100.

FIG. 6 is a flow chart illustrating the nozzle information setting process in the printing apparatus 100.

The nozzle information setting process is a process that creates the nozzle setting information table that sets whether to use the nozzle corresponding to each item of pixel data for each item of pixel data in first image data based on nozzle information. When the process is run at Step S106, as shown in FIG. 6, the process first moves to Step S200.

At Step S200, nozzle information is read out of the nozzle information storing part 12, and the read nozzle information is stored in a predetermined area in the RAM 62 to acquire the nozzle information, moving to Step S202.

At Step S202, an unassigned nozzle number corresponding to first image data is selected from the nozzle information acquired at Step S200, moving to Step S204.

At Step S204, based on discharge/no-discharge information corresponding to the nozzle number selected at Step S202, it is determined whether that selected nozzle is a nozzle of no ink discharge. When it is the nozzle of ink no discharge (Yes), the process moves to Step S206, otherwise (No) the process moves to Step S214.

When the process moves to Step S206, the selected nozzle is set disused for all pixel data corresponding to the selected nozzle, moving to Step S208.

At Step S208, it is determined whether the setting process is completed for all the nozzles. When it is determined that the process is completed (Yes), the process moves to Step S210, otherwise (No) the process moves to Step S202.

On the other hand, when the process moves to Step S214, based on relative discharge accuracy information (relative curved flight information) included in nozzle information, it is determined whether curved flight occurs in the selected nozzle. When it is determined that curved flight occurs (Yes), the process moves to Step S216, otherwise (No) the process moves to Step S218. In this embodiment, based on a data table that sets a setting ratio of the used nozzle to the disused nozzle with respect to an amount of curved flight, a setting is made whether to use a nozzle for each item of pixel data.

When the process moves to Step S216, based on an amount of curved flight of a nozzle that generates curved flight, a setting is made whether to use that nozzle for pixel data corresponding to that nozzle, moving to Step S208.

On the other hand, when the process moves to Step S218, that selected nozzle is set used for all pixel data corresponding to the selected nozzle, moving to Step S220.

Moreover, at Step S208, when the setting process is completed for all the nozzles and the process moves to Step S210, the nozzle setting information table is created based on the setting result, moving to Step S212.

At Step S212, the nozzle setting information table created at Step S210 is stored in the nozzle setting information table storing part 13, and a series of the processes is finished to return to the original process.

Next, with reference to FIG. 7, the second image data creating process at Step S108 will be described in detail.

Figure 7:
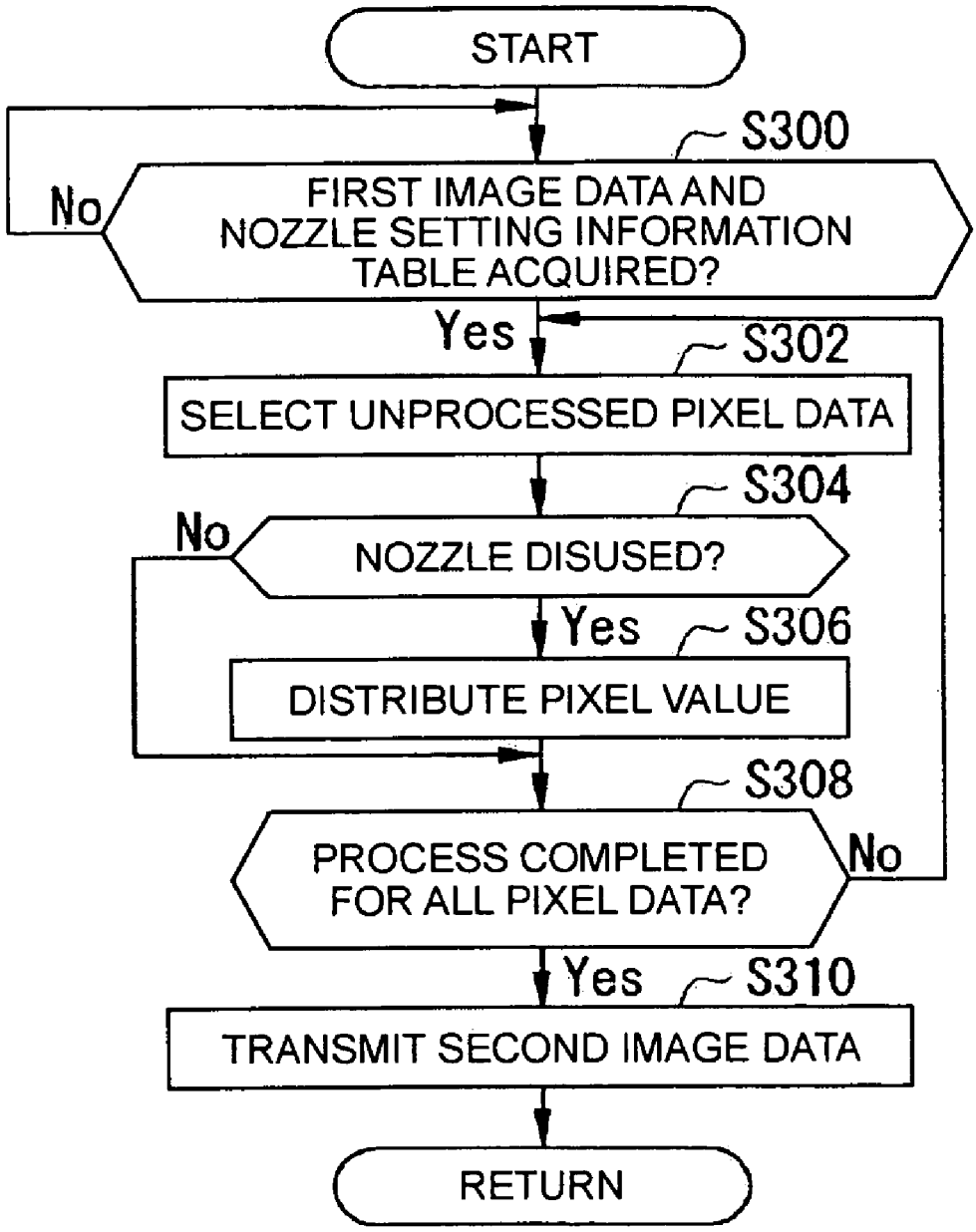
FIG. 7 is a flow chart illustrating a second image data creating process in the printing apparatus 100.

FIG. 7 is a flow chart illustrating the second image data creating process in the printing apparatus 100.

The second image data creating process is a process that changes to the minimum concentration value the pixel value of pixel data that the nozzle is set disused in first image data based on the nozzle setting information table created at the nozzle information setting part 11 and that creates second image data that the original pixel value of that pixel data before changed is distributed to the pixel value of a predetermined pixel located near that pixel. When the process is run at Step S108, as shown in FIG. 7, the process first moves to Step S300.

At Step S300, it is determined whether first image data and the nozzle setting information table are acquired from the nozzle information setting part 11. When it is determined that they are acquired (Yes), the process moves to Step S302, otherwise (No) the determination process is continued until they are acquired.

When the process moves to Step S302, unprocessed pixel data is selected in first image data, moving to Step S304.

At Step S304, based on the nozzle setting information table, it is determined whether the nozzle is set disused for pixel data selected at Step S302. When it is determined that it is set disused (Yes), the process moves to Step S306, otherwise (No) the process moves to Step S308.

When the process moves to Step S306, the pixel value of the selected pixel data is changed to the minimum concentration value (the maximum brightness value) and the original pixel value before changed is distributed to the pixel value of pixels near the selected pixel, moving to Step S308. Here, the pixel value is distributed in such a way that the original pixel value of the selected pixel data at a random ratio to the pixel value of pixels located at above, below, right and left the selected pixel.

At Step S308, it is determined whether the process is completed for all pixel data in first image data. When it is determined that the process is completed (Yes), the process moves to Step S310, otherwise (No) the process moves to Step S302.

When the process moves to Step S310, second image data created by changing the pixel value and by the distribution process described above is transmitted to the N-ary formation processing part 15, and a series of the processes is finished to return to the original process.

Next, with reference to FIGS. 8 to 18, the operation of this embodiment will be described.

Figure 8:
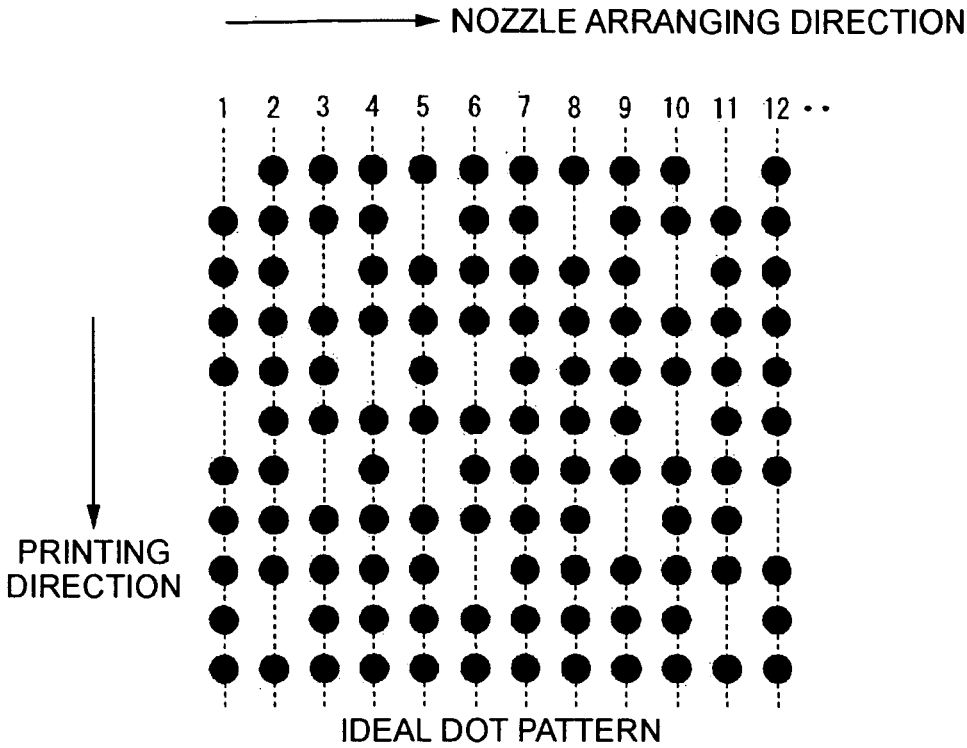
FIG. 8 is a diagram illustrating an exemplary dot pattern generated only by a black nozzle module 50 with no abnormal nozzle that generates curved flight.
Figure 9:
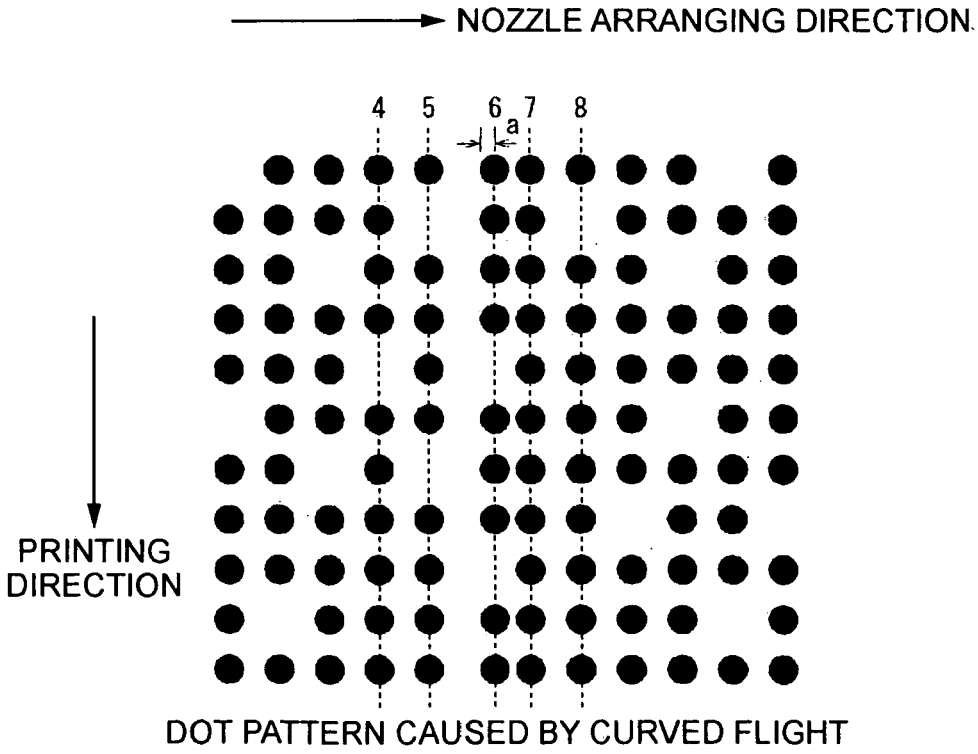
FIG. 9 is a diagram illustrating an exemplary dot pattern generated when a nozzle N6 is generating the curved flight phenomenon in the black nozzle module 50.
Figure 15:
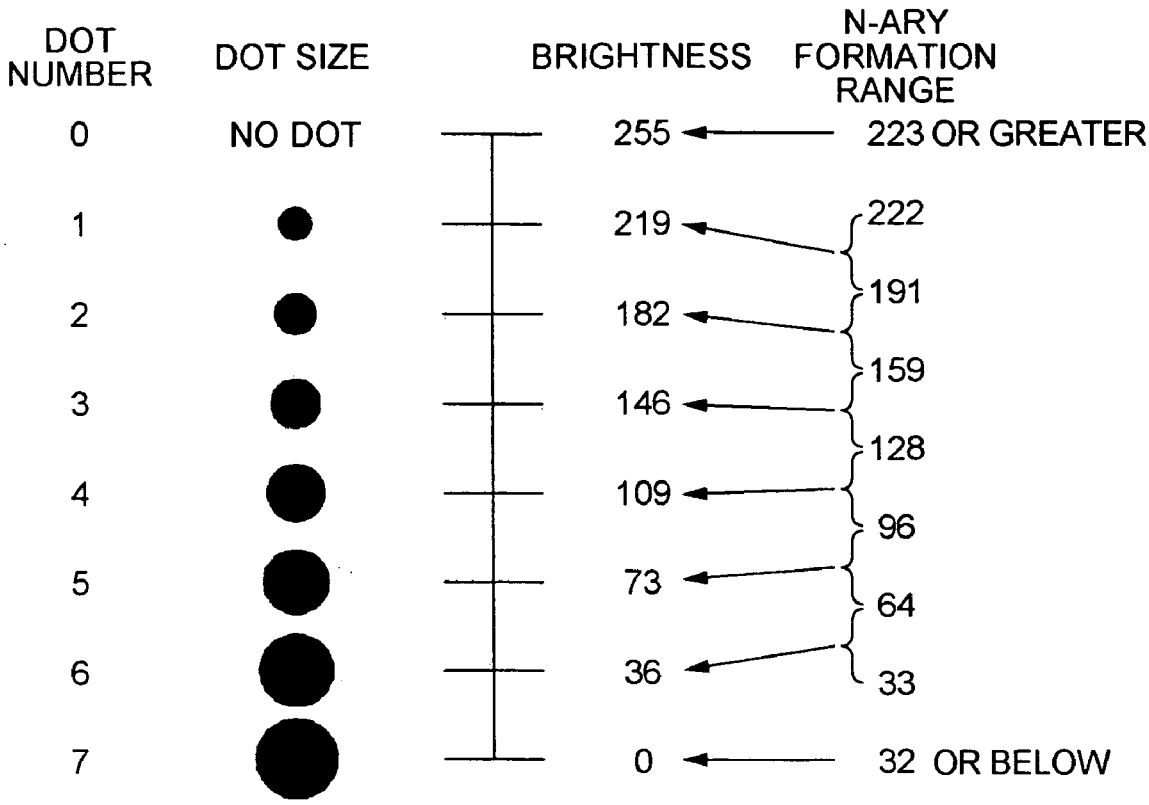
FIG. 15 is a diagram illustrating exemplary N value information and threshold information for each N value with respect to dot size.
Figure 16:
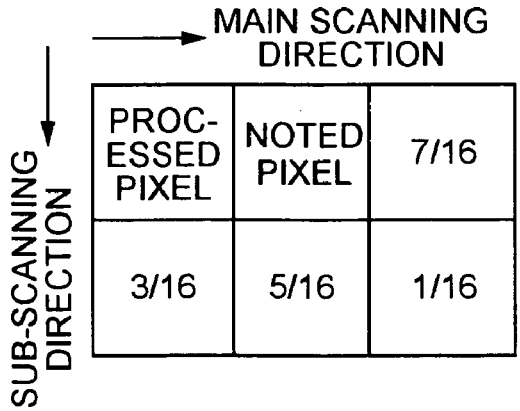
FIG. 16 is a diagram illustrating an exemplary error spread matrix used for an N-ary formation process.

Here, FIG. 8 is a diagram illustrating an exemplary dot pattern that is generated only by the black nozzle module 50 with no abnormal nozzle, and FIG. 9 is a diagram illustrating an exemplary dot pattern that is generated when a nozzle N6 generates the curved flight phenomenon in the black nozzle module 50. Furthermore, FIG. 10A is a diagram illustrating the presence of ink discharge deficiency (in the drawing, no ink discharge) with respect to each of the nozzles, and FIG. 10B is a diagram illustrating relative discharge accuracy information (an amount of curved flight information) with respect to each of the nozzles. Moreover, FIG. 11A is a diagram illustrating a setting information table about discharge/no discharge (use/disuse) with respect to a relative amount x of curved flight, and FIG. 11B is a diagram illustrating exemplary setting information when discharge/no discharge (use/disuse) is set. Furthermore, FIG. 12 is a diagram illustrating an example that a nozzle is set discharged/not discharged (used/disused) based on the setting information table in FIG. 10, and FIG. 13 is a diagram illustrating an example that a nozzle is set discharged/not discharged (used/disused) when a particular curved flight state occurs. Moreover, FIG. 14 is a diagram illustrating an exemplary nozzle setting information table. Furthermore, FIG. 15 is a diagram illustrating exemplary N-ary information for dot size and threshold information for each N-ary. Moreover, FIG. 16 is a diagram illustrating an exemplary error spread matrix used for the N-ary formation process. Furthermore, FIG. 17 is a diagram illustrating an exemplary dot pattern when the nozzle is set not discharged (disused) at random at a 1/2 ratio. FIG. 18 is a diagram illustrating an exemplary dot pattern when the nozzle is set not discharged (disused) at a 2/3 ratio with respect to the relating nozzle for particular curved flight.

As shown in FIG. 8, no banding phenomenon occurs in the dot pattern generated by the black nozzle module 50 with no abnormal nozzle, the banding phenomenon caused by a shift between nozzle intervals such as 'white streaks' and 'thick streaks' as described above.

On the other hand, for the printed result by the black nozzle module 50 including a nozzle generating curved flight, as shown in FIG. 9, the nozzle N6 generates a dot on the right side of a dot generated by normal nozzle N7 as shifted by distance a. Consequently, 'white streak' are generated between the dot generated by the nozzle N6 and the dot generated by nozzle N5 on the left thereof.

On the other hand, when the nozzle modules 52, 54 and 56 corresponding to other colors are used, not the black nozzle module 50, curved flight causes the nozzle N6 to shift by the distance a as described above, and then the distance between the nozzle N6 and the nozzle N7 on the right side thereof is close by the distance a. Therefore, the density of dots created by these nozzles is increased (dots are sometimes overlapped), and this portion is noticeable as a 'thick streak' to degrade print quality.

The 'white streak' described above is a so-called solid filled print, and it is marked more noticeably when the combination of extremely different concentrations such as black ink on white printing paper, extremely degrading print quality.

Therefore, in the printing apparatus 100 of the first embodiment according to the invention, a nozzle likely to cause curved flight and a nozzle with discharge deficiency are disused in first image data, that is, a nozzle is set disused for part or all of pixel data corresponding to the abnormal nozzle. The pixel value of pixel data that the nozzle is set disused is changed to the minimum concentration value, and second image data is created that the pixel value before changed is distributed to the pixel value of predetermined pixels near that pixel. Printing data is created from the generated second image data, printing is done based on the generated printing data, and thus 'white streaks' or 'thick streaks' can be less noticeable that occur in the printed result caused by curved flight and discharge deficiency.

First, when the printing apparatus 100 receives print instruction information from the external unit, etc., at the first image data acquiring part 10 (Step S100), it acquires M-ary image data corresponding to that print instruction information from the external unit, etc., being a source of print instruction information (Step S102). When color information of the acquired image data is other than CMYK, it transforms the data to M-ary CMYK image data as well as it transmits CMYK image data to the nozzle information setting part 11 (Step S104). On the other hand, when the nozzle information setting part 11 acquires CMYK image data from the first image data acquiring part 10, it runs the nozzle information setting process (Step S106).

When the nozzle information setting process is started, nozzle information is first acquired at the nozzle information setting part 11 from the nozzle information storing part 12 (Step S200). Here, as shown in FIG. 10A, nozzle information includes an information table indicating whether or not the presence of ink discharge deficiency in each of the nozzles, and an information table indicating a relative amount of curved flight (discharge accuracy) of each of the nozzles. A nozzle that is not set whether to use/disuse is selected from nozzles corresponding to first image data (Step S202), and it is determined whether that selected nozzle has ink discharge deficiency (here, no discharge) from information indicating whether or not the presence of discharge deficiency corresponding to the selected nozzle in FIG. 10A (Step S204).

Here, when the selected nozzle has ink discharge deficiency (branch 'Yes' at Step S204), the selected nozzle is set disused for pixel data corresponding to the selected nozzle (Step S206).

On the other hand, when the selected nozzle does not have ink discharge deficiency (branch 'No' at Step S204), it is determined whether the selected nozzle causes curved flight based on the information table indicating a relative amount of curved flight with respect to each of the nozzles in nozzle information in FIG. 10B (Step S214). In this embodiment, whether the selected nozzle causes curved flight is determined that the selected nozzle does not cause curved flight when a relative amount x of curved flight with respect to the selected nozzle in FIG. 10B ranges in '$-3<x\leqq+3$' (branch 'No' at Step S214), whereas it is determined that curved flight occurs when the amount in the other range (branch 'Yes' at Step S214). Here, for the relative amount of curved flight shown in FIG. 10B, the symbol is '−' when the dot forming position of the selected nozzle is shifted leftward with respect to the ideal position thereof in the arranging direction of each of the nozzle modules in the print head 200, whereas the symbol is '+' when the dot forming position is shifted rightward with respect to the ideal position thereof.

Furthermore, for the selected nozzle determined that curved flight occurs in the determination process, based on the descriptions set in the setting information table for use/disuse with respect to the relative amount x of curved flight shown in FIG. 11A, when the relative amount x of curved flight with respect to the selected nozzle ranges in '$x\leqq-6$' or '$x\geqq+6$', the selected nozzle is set not discharged (disused) for all the column pixels corresponding to the selected nozzle (Step S206). Moreover, when the relative amount x of curved flight with respect to the selected nozzle ranges in '$-6<x\leqq-3$' or '$+3<x\leqq+6$', a setting is made whether to use the selected nozzle for each item of pixel data corresponding to the selected nozzle at a ratio based on setting information at the time when the selected nozzle is set discharged/not discharged (used/disused) shown in FIG. 11B (Step S216).

More specifically, as shown in FIG. 11B, when the relative amount x of curved flight with respect to the selected nozzle ranges in '$-6<x\leqq-5$' or '$+5<x\leqq+6$', '¼' of pixel columns corresponding to the selected nozzle is set discharged (the nozzle used), and the remaining '¾' is set not discharged (the nozzle disused). Furthermore, when the relative amount x of curved flight with respect to the selected nozzle ranges in '$-5<x\leqq-4$' or '$+4<x\leqq+5$', '½' of pixel columns corresponding to the selected nozzle is set discharged (the nozzle used), and the remaining '½' is set not discharged (the nozzle disused). Moreover, when the relative amount x of curved flight with respect to the selected nozzle ranges in '$-4<x\leqq-3$' or '$+3<x\leqq+4$', '¾' of pixel columns corresponding to the selected nozzle is set discharged (the nozzle used), and the remaining '¼' is set not discharged (the nozzle disused).

For example, when the relative amount x of curved flight with respect to the selected nozzle ranges in '$-4<x\leqq3$' and pixel data of column number '1' corresponding to the selected nozzle, based on setting information in FIG. 11B, as shown in FIG. 12, '0' is set to '¾' of pixel data at column '1' corresponding to the selected nozzle so that ink is discharged (the nozzle is used), '1' is set to the remaining '¼' so that ink is not discharged (the nozzle is disused). Here, also as shown in FIG. 12, numeric '0' that is set to each item of pixel data indicates that ink is set discharged (used), whereas numeric '1' that is set to each item of pixel data indicates that ink is set not discharged (disused).

Furthermore, as similar to the description above, when the relative amount x of curved flight with respect to the selected nozzle ranges in '$-6<x\leqq5$' and pixel data of column number '721' corresponds to the selected nozzle, based on setting information in FIG. 11B, as shown in FIG. 12, '0' is set to '¼' of pixel data at column '721' corresponding to the selected nozzle so that ink is discharged (the nozzle is used), '1' is set to the remaining '¾' so that ink is not discharged (the nozzle is disused). Moreover, similarly, when the relative amount x of curved flight with respect to the selected nozzle ranges in '+4<x≦+5' and pixel data of column number '1438' corresponds to the selected nozzle, based on setting information in FIG. 11B, as shown in FIG. 12, '0' is set to '½' of pixel data at column '1438' corresponding to the selected nozzle so that ink is discharged (the nozzle is used), '1' is set to the remaining '½' so that ink is not discharged (the nozzle is disused).

Furthermore, in this embodiment, when the left hand of two adjacent nozzles generates curved flight in the 'positive' direction and the right-hand nozzle generates curved flight in the 'negative' direction, ⅓ of column pixels corresponding to the nozzle is set not discharged (disused), and the remaining ⅔ is set discharged (used).

For example, as shown in FIG. 13, when the relative amount of curved flight of the left-hand nozzle of two adjacent nozzles ranges in '+4<x≦+5', typically, as shown in FIG. 11B, '½' of pixel columns corresponding to the selected nozzle is set discharged (the nozzle used), and the remaining '½' is set not discharged (the nozzle disused). However, since the relative amount of curved flight of the nozzle adjacent on the right side of the selected nozzle ranges in '−4<x≦−5', in this case, '⅓' of pixel data corresponding to both of the nozzles is set not discharged, and the remaining '⅔' is set discharged.

In addition, in this embodiment, in the setting process using the setting ratio of the selected nozzle set 'discharged/not discharged (used/disused)' in the range of the relative amount x of curved flight of the selected nozzle shown in FIG. 11B, the nozzle is set used/disused for pixel data at random positions so as to have that setting ratio.

Then, when the nozzle information setting part 11 finishes setting all the nozzles to be used for printing first image data in the setting process for the selected nozzle 'discharged/not discharged (used/disused)', it creates a nozzle setting information table as shown in FIG. 14 based on that setting information (Step S210), it transmits the generated nozzle setting information table along with first image data to the second image data creating part 14, and it stores the generated nozzle setting information table in the nozzle setting information table storing part 13 (Step S212).

Here, when the nozzle is in such a discharge deficiency state that it cannot physically discharge ink, as shown in column number '720' in FIG. 14, no discharge '1' is set to all pixel data in the column corresponding to the nozzle with discharge deficiency.

On the other hand, when the second image data creating part 14 acquires the nozzle setting information table and first image data from the nozzle information setting part 11 (branch 'Yes' at Step S300), it selects pixel data that the pixel value is not changed and the distribution process is unprocessed from the acquired first image data Step S302), and it determines whether the nozzle is set not discharged (disused) for the selected pixel data based on the acquired nozzle setting information table (Step S304).

Here, in the nozzle setting information table, in the case where the nozzle is set to no discharge '1' for the selected pixel data (branch 'Yes' at Step S304), for example, when the selected pixel value of pixel data (the brightness value) is '60', this brightness value '60' is changed to '255' that is the maximum brightness value of first image data, and the brightness value '60' before changed is distributed to the pixel value of pixels located near the pixel of the selected pixel data (Step S306). In this embodiment, this distribution process does distribution at a random ratio for the pixels that are adjacent above, below, right and left the selected pixel and the nozzle is set discharged (the nozzle used). For example, when the brightness values of pixels adjacent above, below, left and right the selected pixel are '40' above, '30' below, '160' left, and '200' right, respectively, the brightness value '60−255=−195' of the selected pixel data is distributed at a random ratio in such a way that '−5' for the brightness value above, '−5' for the brightness value below, '−60' for the brightness value left, and '−125' for the brightness value right. Therefore, the pixel value of the pixel above the selected pixel is '40−5=35', the pixel value of the pixel below is '30−5=25', the pixel value of the pixel left is '160−60=100', and the pixel value of the pixel right is '200−125=75'. Here, for example, when the pixel above the selected pixel is also set not discharged (the nozzle disused), distribute '−5' distributed to the above pixel is distributed to any one of three other pixels.

In this manner, the process is finished for all pixel data that the nozzle is set not discharged (the nozzle disused) in first image data that the pixel value of pixel data set not discharged (the nozzle disused) is set to the maximum brightness value and the original pixel value is distributed to of the pixel value of the pixels near the selected pixel (branch 'Yes' at Step S308). Then, first image data after change of the pixel value and the distribution process is second image data, and it is transmitted to the N-ary formation processing part 15 (Step S310).

When the N-ary formation processing part 15 acquires second image data from the second image data creating part 14, it reads N-ary information out of the N-ary information storing part 16, it performs the N-ary formation process for each item of pixel data of second image data based on the read N-ary information, and it creates N-ary image data (Step S110).

More specifically, when the N-ary formation processing part 15 acquires N-ary information, it selects pixel data that does not undergo the N-ary formation process from second image data, and it transforms the value of the M-ary selected pixel data to an N-ary based on the acquired N-ary information.

In this embodiment, in the case where the original pixel value of the selected pixel data (brightness (or concentrations)) is the eight-bit '256' gray scale, as shown in FIG. 15, in the N-ary formation process, when the original pixel value is below '0' to '32', that pixel value is put together to '0' and its N-ary value is '7' corresponding to the dot number. When the original pixel value is below '32' to '64', the pixel value is put together to '36' and its N-ary value is '6' corresponding to the dot number. When the original pixel value is below '64' to '96', the pixel value is put together to '73' and its N-ary value is '5' corresponding to the dot number. Furthermore, similarly, when the original pixel value is below '96' to '128', the pixel value is put together to '109' and its N-ary value is '4' corresponding to the dot number. When the original pixel value is below '128' to '159', the pixel value is put together to '146' and its N-ary value is '3' corresponding to the dot number. When the original pixel value is below '159' to '191', the pixel value is put together to '182' and its N-ary value is '2' corresponding to the dot number. Moreover, when the original pixel value is below '191' to '223', the pixel value is put together to '219' and its N-ary value is '1' corresponding to the dot number. Besides, when the original pixel value is below '223' to '255', the pixel value is put together to '255' and its N-ary value is '0' corresponding to the dot number.

In addition, the example above is the case where brightness is taken as the pixel value. When concentrations are adopted as the pixel value, as shown in brackets in the drawing, the opposite value of each brightness is to be taken (the value that subtracts each brightness value from '255').

Furthermore, when the N-ary formation processing part 15 makes the selected pixel data an N-ary form, it computes an error between the brightness value of the selected pixel data before transformed and the brightness value corresponding to the dot number after transformed, and it spreads the computed error to pixels that do not undergo the N-ary formation process around the pixel of the selected pixel data. The process to spread this error is done based on an error spread matrix as shown in FIG. 16.

Therefore, the N-ary formation process and the error spread process transform the selected pixel data to an N-ary value, and the pixel value of pixel data that does not undergo N-ary formation around the selected pixel data is updated to the value that reflects the error generated by N-ary formation. After that, unprocessed pixel data that is updated in this manner is to sequentially undergo the N-ary and the error spread process.

Then, the N-ary formation process and the error spread process described above are done for all pixel data of second image data, and N-ary image data after the N-ary formation process is transmitted to the printing data creating part 17.

When the correction process is set done, the printing data creating part 17 acquires N-ary image data from the N-ary formation processing part 15, and it creates printing data that corrects the acquired N-ary image data based on the nozzle setting information table stored in the nozzle setting information table storing part 13. However, in this embodiment, suppose the correction process is not set done, the N-ary image data is printing data (Step S112), and the printing data is outputted to the printing part 18 (Step S114). In addition, for the correction process for N-ary image data with respect to the correction process being set done, it will be described in a second embodiment as a modification of the first embodiment.

On the other hand, the printing part 18 acquires printing data outputted from the printing data creating part 17, and it uses the black nozzle module 50 to create (prints) dots in the size corresponds to each dot number on a printing medium based on the acquired printing data (Step S116).

Furthermore, for a technical scheme to control dot size in this manner, for example, in a system that a piezo actuator is used for the print head, it can be easily implemented by varying voltage applied to the piezo actuator to control an ink discharge amount.

As described above, for pixel data at the position where the banding phenomenon occurs because of the curved flight phenomenon by the nozzle and ink discharge deficiency in the nozzle, as shown in FIGS. 11A and 11B, the nozzle is set discharged/not discharged (used/disused) for pixel data corresponding to the nozzle that generates curved flight in accordance with setting ratio information about the nozzle discharge/no discharge (use/disuse) depending on the amount of curved flight set beforehand, and thus a phenomenon that visually recognizes white streaks or thick streaks can be made less noticeable than the created result of the dot pattern shown in FIG. 9.

Figure 17A:
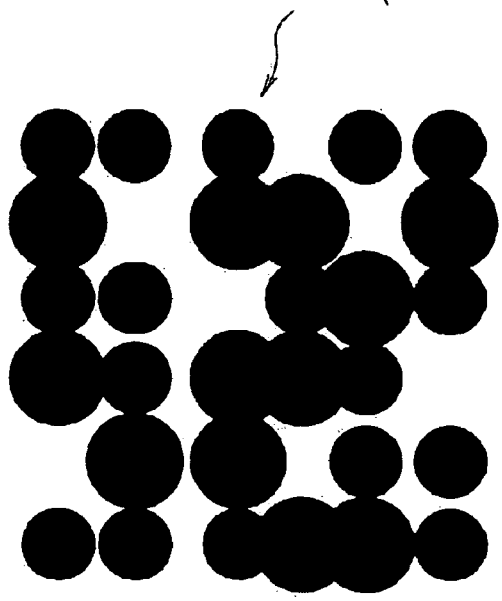
FIGS. 17A and 17B are diagrams illustrating an exemplary dot pattern when nozzles are set not discharged (disused) at random at a ratio of 1/2.
Figure 17B:
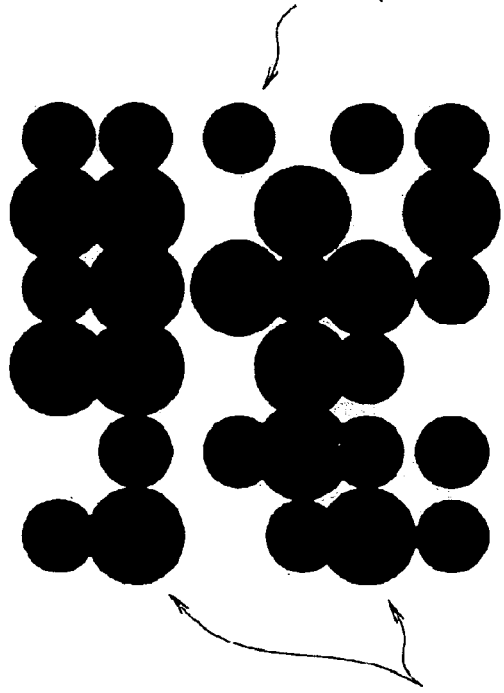

More specifically, for example, as shown in FIG. 17A, in the case where curved flight causes the dot forming position of a nozzle to be shifted more rightward than the ideal position and dots in column pixels of this nozzle are overlapped with dots in column pixels of the adjacent nozzle, suppose the relative amount x of curved flight of this nozzle ranges in '$+4<x\leqq+5$', in the nozzle information setting part 11. In accordance with setting information shown in FIG. 11B, '½' of column pixels corresponding to the nozzle is set as ink not discharged (the nozzle disused), and the remaining '½' is set as ink discharged (the nozzle used). When second image data is created at the second image data creating part 14 according to the descriptions thus set, as shown in FIG. 17B, dots are not created with respect to ½ of column pixels corresponding to the nozzle that generates curved flight in the printed result of printing data after the N-ary formation process. Therefore, 'thick streaks' caused by curved flight are lessened, and banding is less noticeable.

Figure 18A:
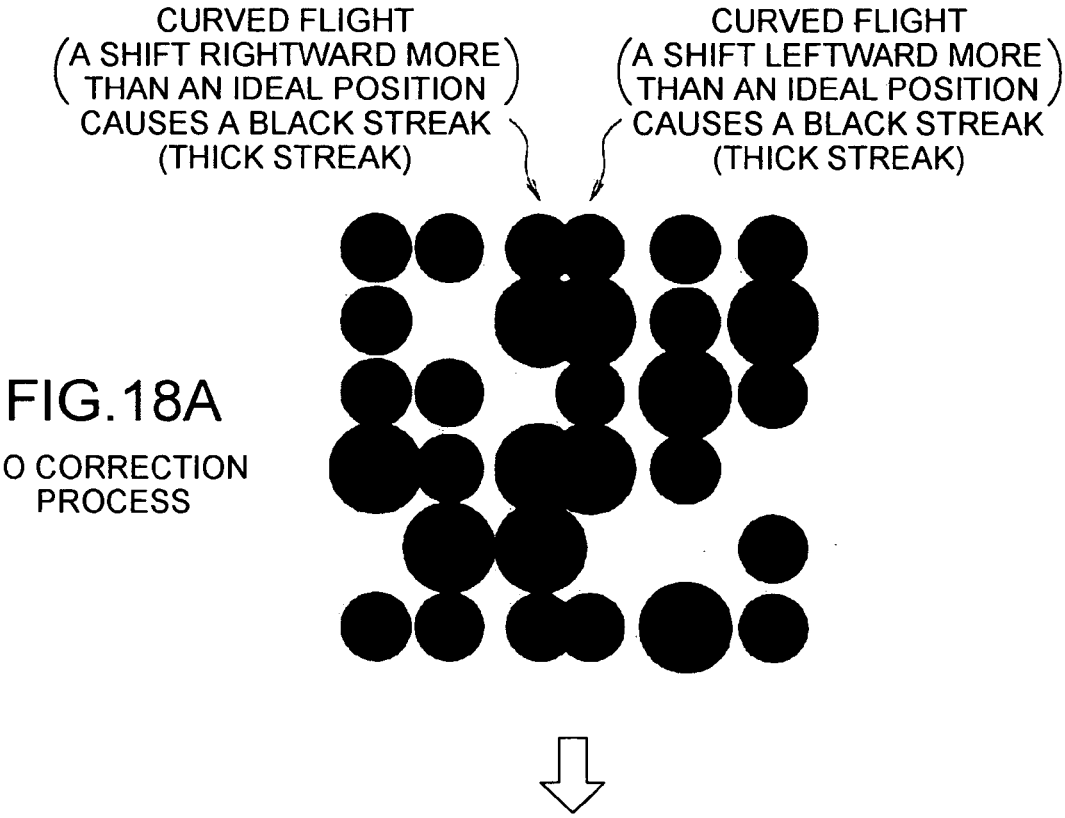
FIGS. 18A and 18B are diagrams illustrating an exemplary dot pattern when nozzles are set not discharged (disused) at a ratio of 2/3 with respect to the related nozzles for particular curved flight.
Figure 18B:
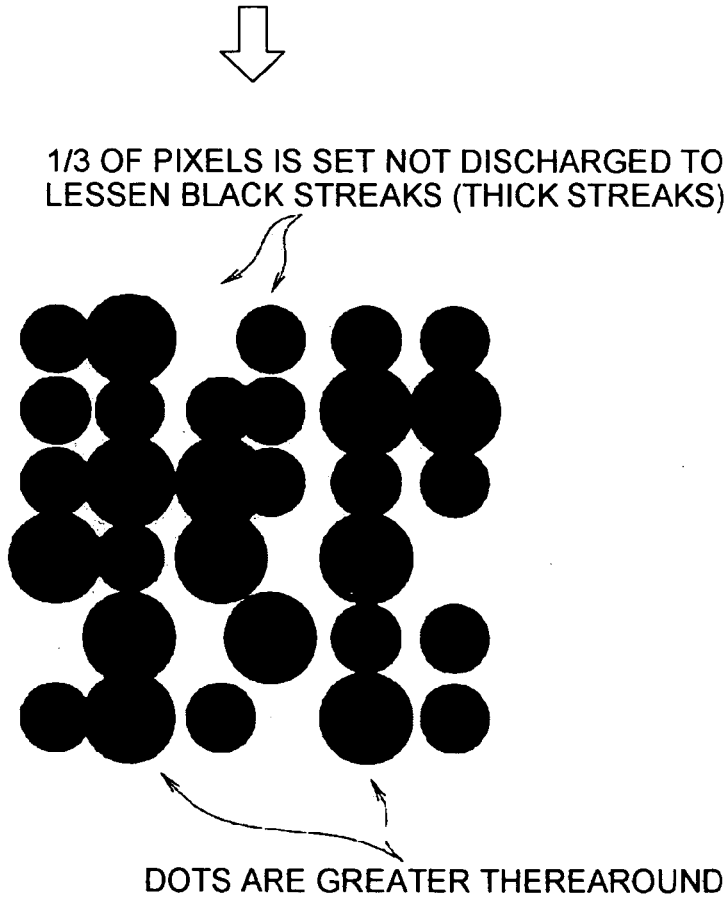

Moreover, for example, as shown in FIG. 18A, two adjacent nozzles are shifted in such a way that the dot forming position of the left nozzle is shifted rightward and the dot forming position of the right nozzle is shifted leftward to overlap dots in both columns because of curved flight. Suppose the relative amount x of curved flight of the left nozzle ranges in '$+4<x\leqq+5$', the relative amount x of curved flight of the right nozzle ranges in '$-5<x\leqq4$' at the nozzle information setting part 11. This case is considered as an exception process; ⅓ of column pixels corresponding to both nozzles is set not discharged and the remaining ⅔ is set discharged for both of the nozzles. When second image data is created at the second image data creating part 14 depending on the descriptions thus set, as shown in FIG. 18B, that setting does not create dots in ⅓ of column pixels corresponding to the nozzle that generates curved flight in the printed result of printing data after the N-ary formation process. Therefore, 'thick streaks' caused by curved flight are lessened, and banding is less noticeable.

In addition, in the example shown in FIG. 18A, when ½ or greater of column pixels corresponding to the nozzle is set not discharged for both of the adjacent nozzles that generate curved flight in accordance with setting information shown in FIG. 11B, a situation might occur that the gray scale for the pixels that the nozzle is set not discharged cannot always be corrected by surrounding pixels. Thus, in this embodiment, when the two adjacent nozzles generate curved flight in this manner, a limitation is imposed on the number of pixels set not discharged as an exception.

Furthermore, with reference to FIGS. 19 to 22, the effects according to the invention will be described more specifically as an example is taken.

Figure 19:
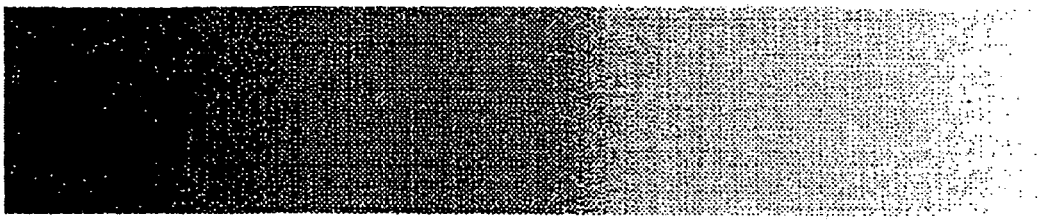
FIG. 19 is a gradation image used in this embodiment.
Figure 20:
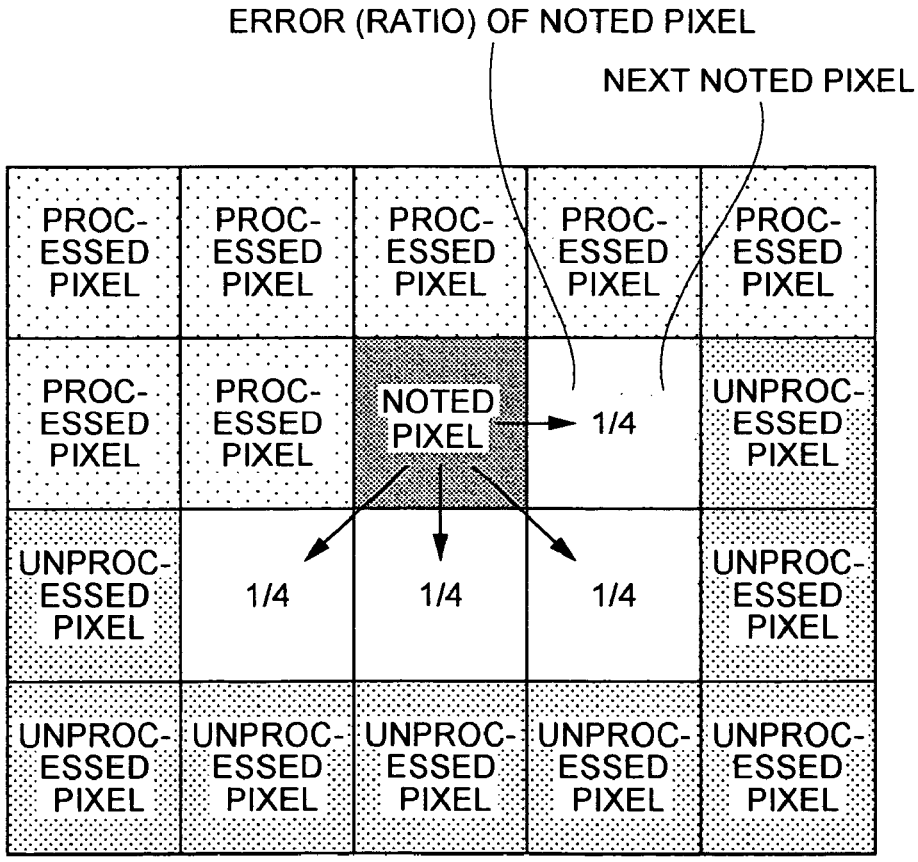
FIG. 20 is an error spread matrix used in an embodiment.
Figure 21:
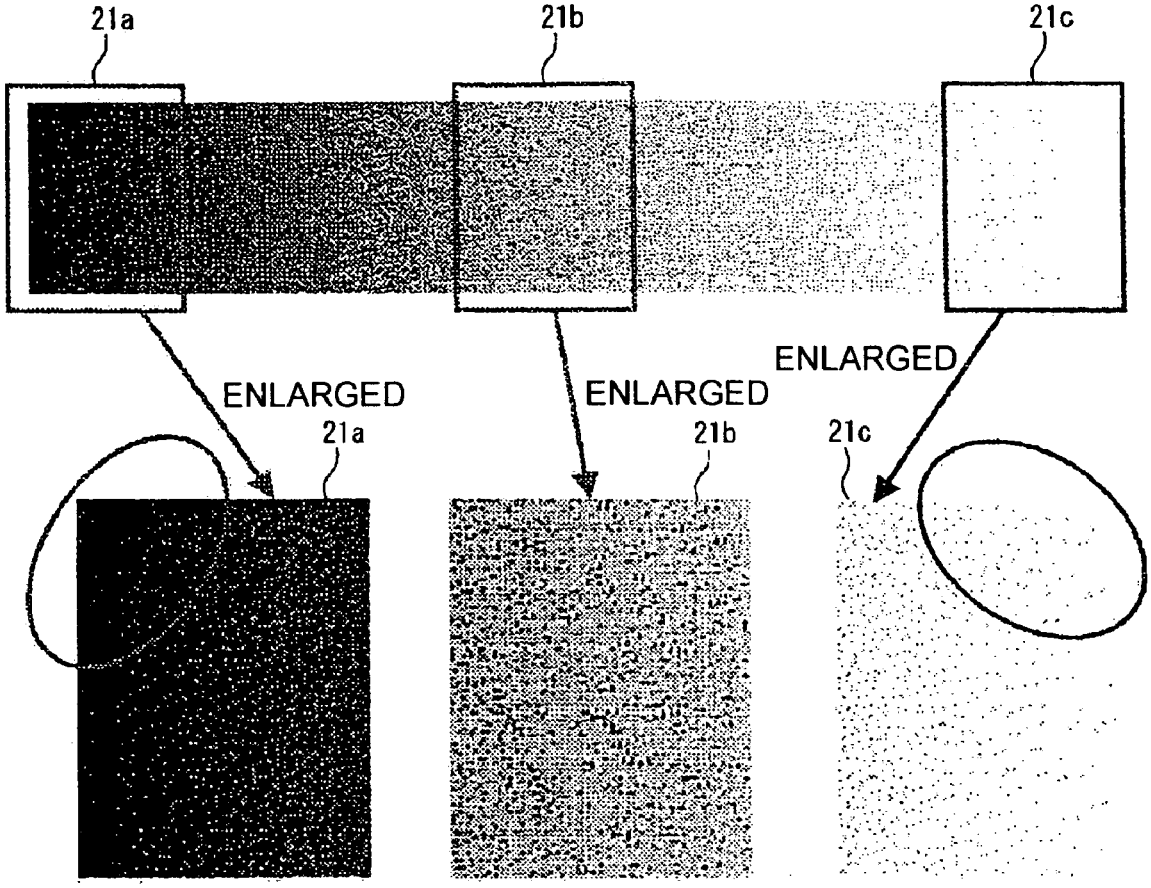
FIG. 21 is a diagram illustrating the result that the gradation image in FIG. 19 is simply formed in four-ary using the error spread matrix in FIG. 20 with no use of a scheme according to the invention.
Figure 22:
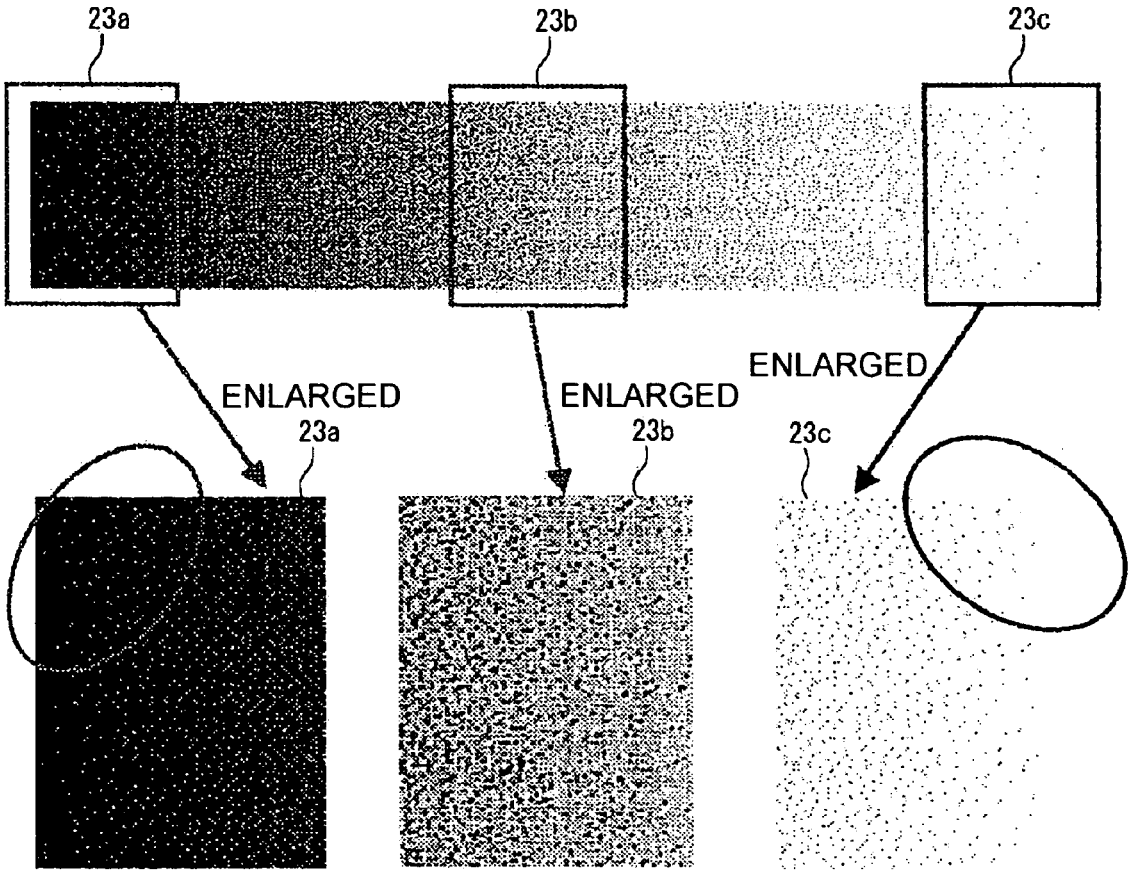
FIG. 22 is a diagram illustrating the result that the gradation image in FIG. 19 is formed in four-ary using the scheme according to the invention.

Here, FIG. 19 is a gradation image used in this example. Moreover, FIG. 20 is an error spread matrix used in this example. FIG. 21 is a diagram illustrating the result that the gradation image in FIG. 19 is simply formed in four-ary data by using the error spread matrix in FIG. 20 with no use of the scheme according to the invention. FIG. 22 is a diagram illustrating the result that the gradation image shown in FIG. 19 is formed in four-ary data with the scheme according to the invention. In addition, the 'error spread matrix' is a matrix that contains information such as information (such as relative position information) indicating the position (the spread direction) of spread target pixel data with respect to spread source pixel data and information about the spread ratio for each spread target pixel data, after transformation of M-ary pixel data to N-ary data in the N-ary formation process, when the differential (error) between N-ary data after transformed and M-ary data before transformed is spread (distributed) to pixel data around that pixel data that does not undergo the N-ary formation process (it is generally called the error spread scheme). There are various types of error spread matrices that vary in the matrix shape, matrix size (the number of spread targets), the spread ratio, etc.

First, the image after four-ary formation by the traditional scheme will be described.

The image after four-ary formation of a gradation image by the traditional scheme is as shown in FIG. 21. When attention is focused on image portions 21*a* to 21*c* in the gradation image after four-ary formation in FIG. 21, in the image portion 21*a*, dot types in printing are not switched smoothly (dots have multiple types of size), and a delay occurs in switching dot types. Thus, particularly in the portion circled, dots are created so as to flow into the direction right below. Furthermore, in the image portion 21*b* (half tones), because of the same reason as 21*a*, since multiple types of dots forming this portion are not mixed evenly, image quality is degraded. Moreover, in the image portion 21*c*, because of the same reason as 21*a* and 21*b*, particularly in the portion circled, a so-called dot tailing phenomenon occurs that dots flow into the direction right below.

Each phenomenon that occurs in the enlarged image portions 21*a* to 21*c* degrades image quality of the gradation image.

On the other hand, the result that the gradation image shown in FIG. 19 underwent four-ary formation and the error spread process by using the scheme according to the invention shown in FIG. 16 is as in FIG. 22. When attention is focused on image portions 23*a* to 23*c* in the gradation image after four-ary formation in FIG. 22, in the image portion 23*a*, a delay in switching dot types is improved more than in the traditional scheme, dispersion properties of dot types in the shadow part are improved, and image quality is better than the image portion 21*a* in FIG. 21. Furthermore, in the image portion 23*b*, multiple types of dots are mixed evenly more than the traditional scheme, and image quality is improved more than the image portion 21*b* in FIG. 21. Moreover, in the image portion 23*c*, the dot trailing phenomenon in the highlighted part is improved more than in the traditional scheme, and image quality is better than the image portion 21*c* in FIG. 21.

In the first embodiment, the first image data acquiring part 10 corresponds to the image data acquiring module in aspect 1 or 21, the nozzle information storing part 12 corresponds to any one of the nozzle information storing modules in aspects 1, 9, 16 and 22, the nozzle information setting part 11 and the nozzle setting information storing part 13 correspond to any one of the nozzle use information setting modules in aspects 1, 3, 22 and 24, the second image data creating part 14 corresponds to any one of second image data creating modules in aspects 1, 4, 22, 25 and 37, the N-ary formation processing part 15 and the N-ary information storing part 16 correspond to the N-ary formation process module in aspect 1 or 22, the printing data creating part 17 corresponds to any one of printing data creating modules in aspects 1, 5 and 22, and the printing part 18 corresponds to the printing module in aspect 1 or 6.

In the first embodiment, Steps S102 and S104 correspond to any one of the first image data acquiring steps in aspects 9, 16 and 28, Step S106 corresponds to any one of the nozzle use information setting steps in aspects 9, 11, 16, 18, 28, 30, 32, 34, 36 and 39, Step S108 corresponds to any one of the second image data creating steps in aspects 9, 12, 16, 19, 28, 31 and 34, Step S110 corresponds to any one of the N-ary formation processing steps in aspects 9, 16, 28 and 34, Step S112 corresponds to any one of the printing data creating steps in aspects 9, 13, 16, 20, 28 and 34, and Step S116 corresponds to any one of the printing steps in aspects 9, 14, 16 and 20.

Second Embodiment

Figure 23:
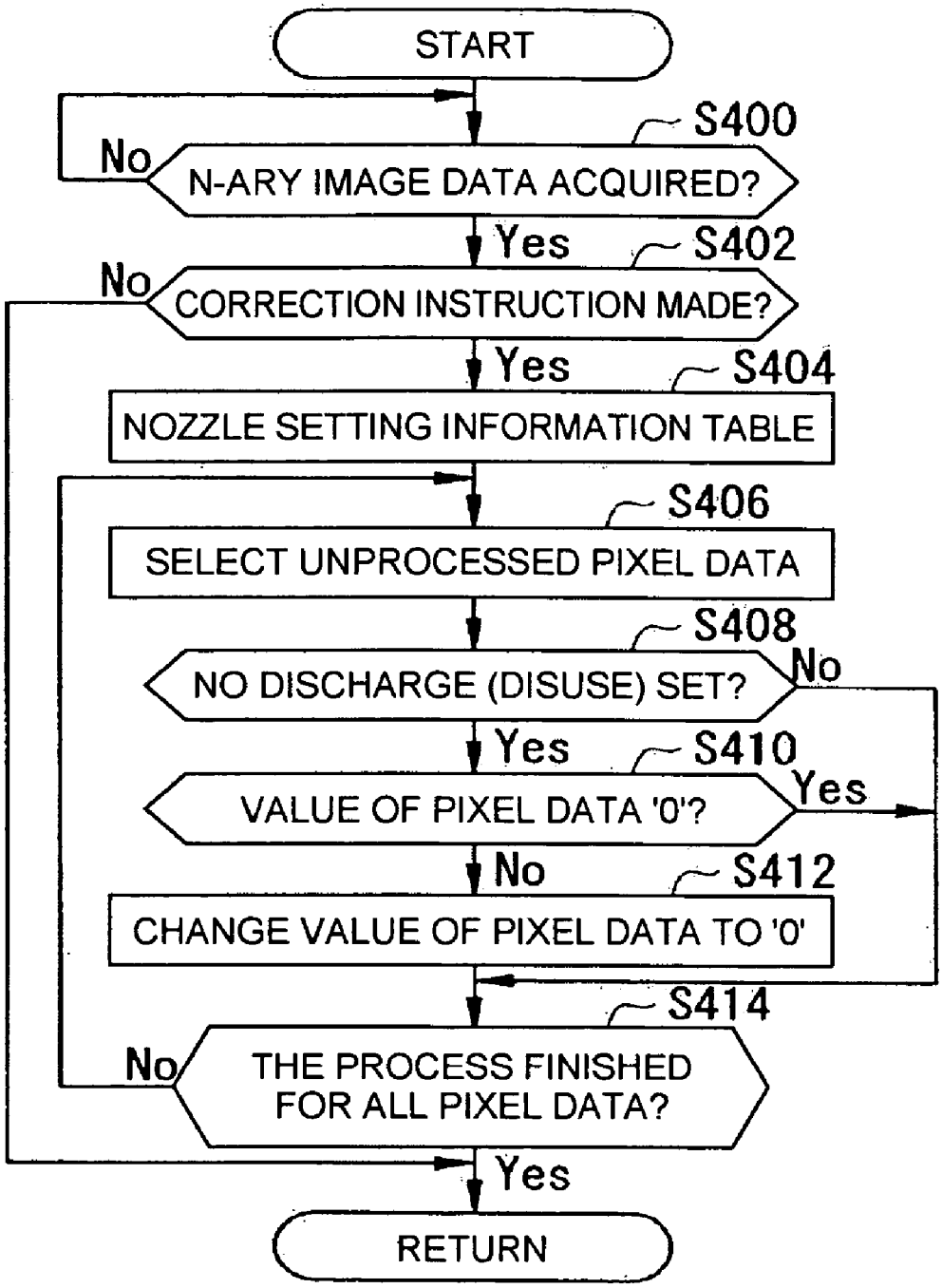
FIG. 23 is a flow chart illustrating a printing data creating process in a printing data creating part 17 in the printing apparatus 100.

Next, a second embodiment according to the invention will be described with reference to the drawings. FIGS. 23 and 24 are diagrams illustrating the second embodiment of the printing apparatus, the printing apparatus control program, the printing apparatus control method, the printing data creating apparatus, the printing data creating program, and the printing data creating method according to the invention.

The configurations of a printing apparatus and a computer system of this embodiment are the same as those of the first embodiment in FIGS. 1 and 2. In this embodiment, in the printing data creating process done at Step S112 of the first embodiment in FIG. 5, a correction process for N-ary image data shown in FIG. 23 is done.

The correction process for N-ary image data in FIG. 23 is a process below. Ink is set not discharged (the nozzle disused) at a nozzle information setting part 11, and the pixel value of pixel data that the pixel value is changed to the minimum concentration value receives error from surrounding pixels by the error spread process at an N-ary formation processing part 15. When the pixel value is changed to the pixel value to create dots, N-ary image data is corrected based on the nozzle setting information table stored in a nozzle setting information table storing part 13 at a printing data creating part 17. More specifically, it is the process that pixel data that is set not ink discharged while dots are created in N-ary image data is changed to not creating dots.

Hereinafter, only the portions different from the first embodiment will be described, omitting the description of the portions overlapping the first embodiment.

With reference to FIG. 23, the printing data creating process at Step S112 in this embodiment will be described in detail.

FIG. 23 is a flow chart illustrating the printing data creating process at the printing data creating part 17 in a printing apparatus 100.

The printing data creating process is done at Step S112, and it first moves to Step S400 as shown in FIG. 23.

At Step S400, it is determined whether N-ary image data is acquired from the N-ary formation processing part 15. When it is determined that it is acquired (Yes), the process moves to Step S402, otherwise (No) the determination process is continued until acquired.

When the process moves to Step S402, it is determined whether a correction instruction is made (correction setting). When it is determined that it is made (Yes), the process moves to Step S404, otherwise (No) a series of processes is finished to return to the original process. More specifically, when no correction instruction is made, the process is the same as the first embodiment.

When the process moves to Step S404, the nozzle setting information table is read out of the nozzle setting information table storing part 13, and the read nozzle setting information table is stored in a predetermined area in RAM 62 to acquire the nozzle setting information table, moving to Step S406.

At Step S406, pixel data that does not undergo the correction process is selected from N-ary image data, moving to Step S408.

At Step S408, it is determined whether the nozzle is set not discharged (disused) for the selected pixel data based on the nozzle setting information table. When it is determined that it is set not discharged (disused) (Yes), the process moves to Step S410, otherwise (No) the process moves to Step S412.

When the process moves to Step S410, it is determined whether the value of the selected pixel data is '0'. When it is determined that it is '0' (Yes), the process moves to Step S414, otherwise (No) the process moves to Step S412. More specifically, it is determined whether the value of pixel data is nozzle number '0' (no dots).

When the process moves to Step S412, the selected value of pixel data is changed to '0', moving to Step S414.

On the other hand, when the process moves to Step S414, it is determined whether the process is finished for all pixel data. When it is determined that it is finished (Yes), a series of processes is finished to return to the original process, otherwise (No) the process moves to Step S406.

Next, with reference to FIG. 24, the operation of this embodiment will be described. Here, FIG. 24A is a diagram illustrating an ideal dot forming pattern by no discharge setting, and FIG. 24B is a diagram illustrating an example that a dot is created at the no discharge portion because of error spread.

The printing data creating process in this embodiment is started by acquiring N-ary image data from the N-ary formation processing part 15 at the printing data creating part 17 (branch 'Yes' at Step S400). First, it is determined whether the correction process is set (Step S402). By this determination, when a correction instruction is made by a user to set to do correction (branch 'Yes' at Step S402), the nozzle setting information table is read out of the nozzle setting information table storing part 13 and stored in a predetermined area in the RAM 62 (Step S404), and pixel data that does not undergo the correction process is selected from N-ary image data (Step S406). When pixel data is selected, the printing data creating part 17 then determines whether the nozzle corresponding to the selected pixel data is set not discharged (disused) for the selected pixel data based on the acquired nozzle setting information table (Step S408). More specifically, when '1' is set to the selected pixel data in the nozzle setting information table, the nozzle is set not discharged, whereas '0' is set, the nozzle is set discharged.

Here, when the nozzle is set not discharged for the selected pixel data (branch 'Yes' at Step S408), it is further determined whether the value of the selected pixel data is '0' corresponding to 'no dots' in the nozzle number (Step S410). More specifically, when the value of selected pixel data is other than '0' while the nozzle is set not discharged (branch 'No' at Step S410), dots are to be created for the selected pixel data. In order not to create dots, the value of the selected pixel data is changed to '0' (Step S412).

Figure 24B:
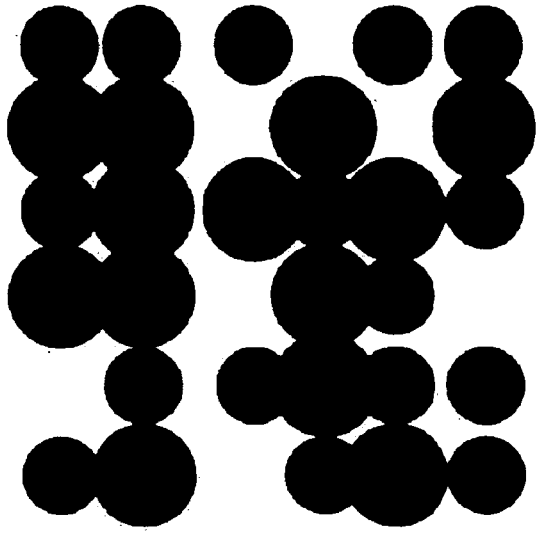
FIG. 24B is a diagram illustrating an example that a dot is generated in a no discharge portion by error spread.
Figure 24A:
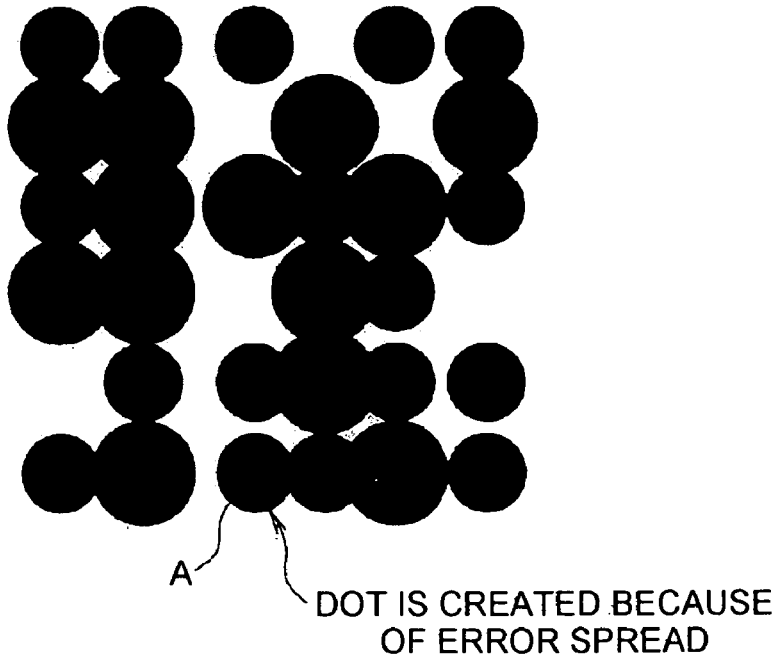
FIG. 24A is a diagram illustrating an ideal dot forming pattern by setting no discharge.

More specifically, for example, as shown in FIG. 24B, when the pixel value of the pixel that has received error from surrounding pixels in the error spread process is changed to create dot A where no dots are originally created while the nozzle is set not discharged, the value of pixel data to create this dot A is changed to '0', and thus the dot A is not created, as shown in FIG. 24A. Therefore, an intended dot pattern can be formed.

Then, all pixel data in N-ary image data undergoes the determination process and the correction process (branch 'Yes' at Step S414), and printing data is created.

In addition, in this embodiment, in order not to create any dots for pixel data that the nozzle is set not discharged but dots are to be created because of the influence of the error spread process, printing data that N-ary image data is corrected is created for handling based on the nozzle setting information table. However, not limited this, dots are created at the printing part 18 as the nozzle setting information table is referenced. Thus, for pixel data that the nozzle is set not discharged, control can be done so as not to create any dots even though the value is set other than '0'. Therefore, it can be secured not to create any dots for pixel data that the nozzle is set not discharged.

In the second embodiment, the first image data acquiring part 10 corresponds to the image data acquiring module in aspect 1 or 21, the nozzle information storing part 12 corresponds to any one of the nozzle information storing modules in aspects 1, 9, 16 and 22, the nozzle information setting part 11 and the nozzle setting information storing part 13 correspond to any one of the nozzle use information setting modules in aspects 1, 3, 5, 6, 22, 24, 26 and 27, the second image data creating part 14 corresponds to any one of second image data creating modules in aspects 1, 4, 22 and 25, the N-ary formation processing part 15 and the N-ary information storing part 16 correspond to the N-ary formation process module in aspect 1 or 22, the printing data creating part 17 corresponds to any one of the printing data creating modules in aspects 1, 5, 22 and 26, and the printing part 18 corresponds to the printing module in aspect 1 or 6.

In the second embodiment, Steps S102 and S104 correspond to any one of the first image data acquiring steps in aspects 9, 16, 28 and 36, Step S106 corresponds to any one of the nozzle use information setting steps in aspects 9, 11, 13, 14, 16, 18, 20, 21, 28, 30, 32, 34, 36, 38 and 39, Step S108 corresponds to any one of the second image data creating steps in aspects 9, 12, 16, 19, 28, 31 and 34, Step S110 corresponds to any one of the N-ary formation processing steps in aspects 9, 16, 28 and 34, Step S112 corresponds to any one of the printing data creating steps in aspects 9, 13, 16, 20, 28 and 34, and Step S116 corresponds to any one of the printing steps in aspects 9, 14, 16 and 20.

In addition, the feature of the printing apparatus in the first and second embodiments is in that an existing printing apparatus is little modified itself to create printing data from image data in matching with the properties of its print head. Therefore, it is unnecessary to prepare a unit exclusive use for the printing part 18 particularly, and a printer of a traditional existing ink jet printing method can be used as it is. Furthermore, when the printing part 12 is separated from the printing apparatus 100 in the embodiment, the function can be implemented only by a general-purpose print instruction terminal (printing data creating apparatus) such as PC.

Moreover, the printing apparatus 100 in the first and second embodiments may be implemented as a network system that is connected to an existing printer of the ink jet printing method, other units, a terminal, and deices as communication is allowed. In this case, the first image data acquiring part 10, the nozzle information setting part 11, the nozzle information storing part 12, the nozzle setting information table storing part 13, the second image data creating part 14, N-ay processing part 15, the N-ary information storing part 16, and the printing data creating part 17 may belong to any one of other units, a terminal, and devices.

Furthermore, the invention can be of course adapted not only to the curved flight phenomenon but also to the case where the ink discharge direction is vertical (normal) but the nozzle forming descriptions are shifted from the normal position, and thus dots to be created result in the same as those in the curved flight phenomenon.

Moreover, the printing apparatus 100 in the first and second embodiments can be adapted not only to the line scan head type ink jet printer but also to the multipath type ink jet printer. When it is the line scan head type ink jet printer, high quality prints can be obtained by a single path with less noticeable white streaks and thick streaks even though the curved flight phenomenon, etc., occur. Besides, when it is the multipath type ink jet printer, the number of reciprocation can be reduced to allow higher speed printing than traditional printing.

Figure 25A:
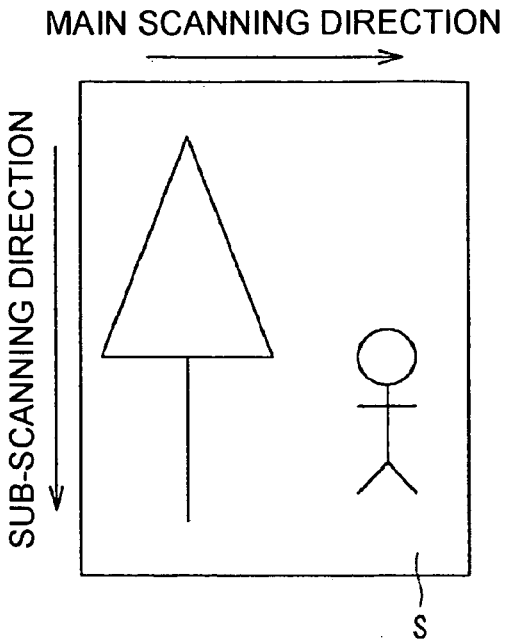
FIG. 25A to 25C are illustrations depicting the difference between the multipath type ink jet printer and the line scan head type ink jet printer print system.
Figure 25B:
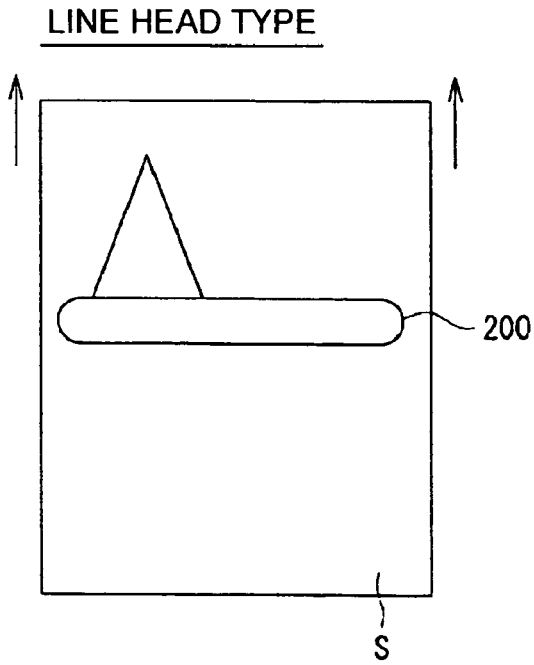
Figure 25C:
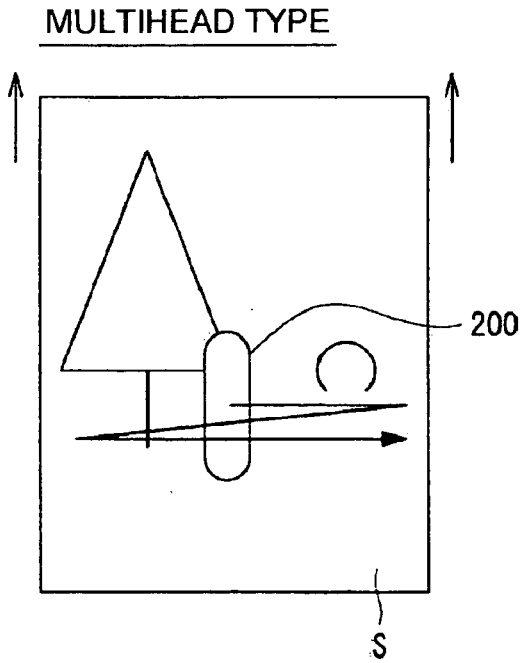

FIGS. 25A to 25C depict printing methods of the line scan head type ink jet printer and the multipath type ink jet printer.

As shown in FIG. 25A, suppose the width direction of rectangular printing paper S is the main scanning direction of image data and the longitudinal direction is the sub-scanning direction of image data. As shown in FIG. 25B, in the line scan head type ink jet printer, the print head 200 has a length of the width of the printing paper S, the print head 200 is fixed, and the printing paper S is moved in the sub-scanning direction with respect to the print head 200 to complete printing by a so-called single scan (a single path operation). Furthermore, printing can be done in such a way that printing paper S is fixed and the print head 200 is moved in the sub-scanning direction as a flat head type scanner, or that both are moved in the opposite directions. On the other hand, as shown in FIG. 25C, in the multipath type ink jet printer, printing is done in which the print head 200 that is much shorter than the length of paper width is placed at the direction orthogonal to the main scanning direction and it is repeatedly reciprocated in the main scanning direction while moving the printing paper S in the sub-scanning direction by predetermined pitches. Therefore, in the case of the latter multipath type ink jet printer, although it has a disadvantage that it takes time for printing more than the former line scan head type ink jet printer, it can place the print head 200 at a given position repeatedly. Thus, it can particularly cope with a reduction in the white streak phenomenon to some extend in the banding phenomenon described above.

Moreover, the ink jet printer is taken and explained as an example that ink is discharged in dots for printing in the first and second embodiments. However, the invention can also be adapted to another printing apparatus using a print head having a printing mechanism arranged in a line, for example, to a so-called thermal head printer such as a thermal transfer printer or thermal printer.

Figure 26:
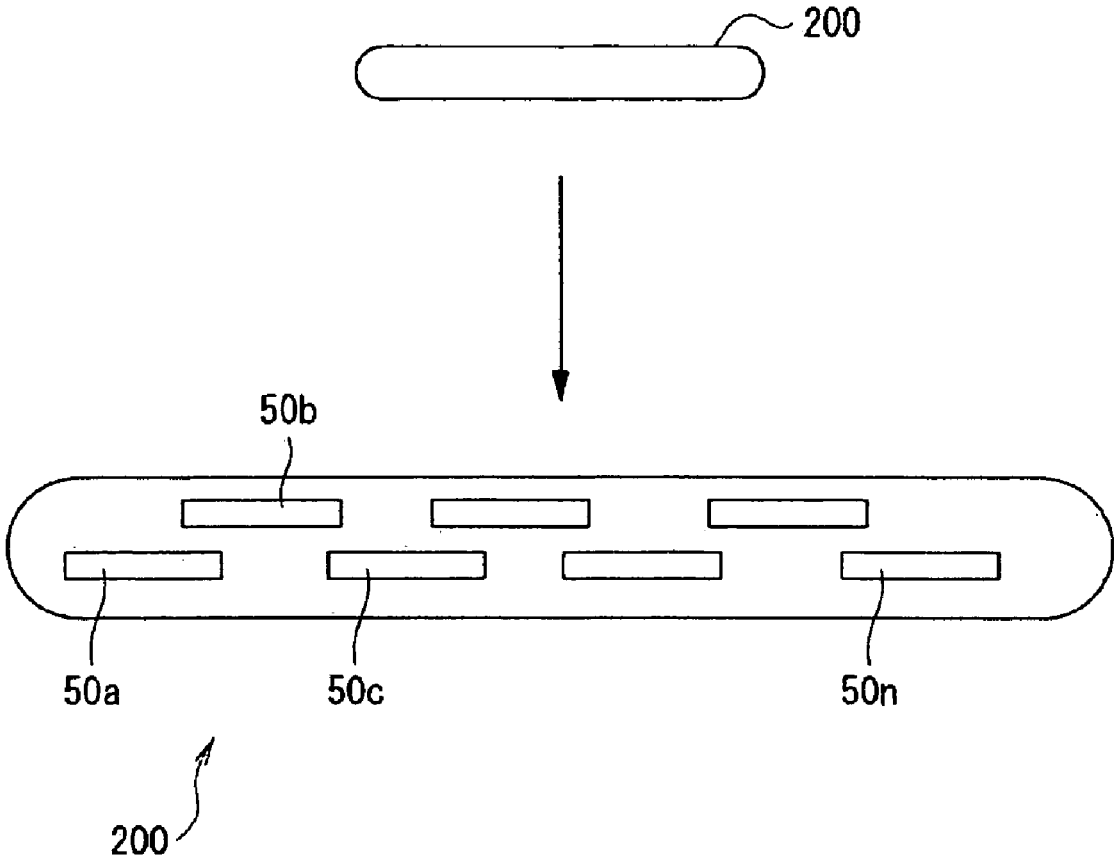
FIG. 26 is a conceptual diagram illustrating another example of the structure of the print head.

Besides, in FIG. 3, each of the nozzle modules 50, 52, 54, and 56 disposed for each color in the print head 200 is in the form that the nozzles N are continuously arranged linearly in the longitudinal direction of the print head 200. However, as shown in FIG. 26, it may be configured in which each of the nozzle modules 50, 52, 54, and 56 is configured of a plurality of short nozzle units 50*a*, 50*b*, to 50*n* and they are arranged before and after the moving direction of the print head 200. Particularly, when each of the nozzle modules 50, 52, 54, and 56 is configured of a plurality of the short nozzle units 50*a*, 50*b*, to 50*n*, the distance between dots can be substantially shortened without shortening the actual distance between dots (pitches) of each of the nozzles units 50*a*, 50*b*, to 50*n*. Therefore, the apparatus can cope with high a resolution image easily.

What is claimed is:

1. A printing apparatus which is capable of printing an image on a printing medium by a print head having a nozzle that is capable of creating two or more types of dots varied depending on size, the printing apparatus comprising:

a first image data acquiring module that acquires first image data having a plurality of items of pixel data corresponding to an M-ary pixel value (M≧3);

a nozzle information storing module that stores nozzle information indicating a property of the nozzle;

a nozzle use information setting module that sets whether to use a nozzle corresponding to each item of pixel data for each item of the pixel data of the first image data based on the nozzle information;

a second image data creating module that changes to a minimum concentration value a pixel value of pixel data set not to use a nozzle by the nozzle use information setting module in the first image data, and creates second image data that an original pixel value before changed is distributed to a pixel value of an unprocessed pixel located near that pixel value;

an N-ary formation process module that performs an N-ary formation process to create third image data, the process being that an M-ary pixel value (M≧3) of pixel data in second image data is transformed to an N-ary value (M>N≧2);

a printing data creating module that creates printing data that defines information about dot forming descriptions of the nozzle corresponding to the third image data; and a printing module that prints the image on the medium by the print head based on the printing data.

2. The printing apparatus according to claim 1, wherein:

the nozzle information includes information indicating whether or not a presence of ink discharge deficiency in the nozzle; and the nozzle use information setting module sets a nozzle disused for all pixel data corresponding to the nozzle with the ink discharge deficiency.

3. The printing apparatus according to claim 1 or 2, wherein the nozzle information includes information about a position shift between an actual position of the dot formed by the nozzle and an ideal forming position of that dot.

4. The printing apparatus according to claim 3, wherein the nozzle use information setting module sets a nozzle disused for part of pixel data corresponding to a nozzle having a position shift greater than a predetermined amount.

5. The printing apparatus according to claim 1, wherein in the process that distributes the original pixel value, the second image data creating module distributes the original pixel value before changed to a pixel value of pixel image located near pixel image of that pixel value at a random ratio.

6. The printing apparatus according to claim 1, wherein:

the nozzle use information setting module creates a nozzle setting information table formed of information that sets whether to use a nozzle corresponding to each item of pixel data for each item of the pixel data in the first image data; and the N-ary formation process module creates the third image data that the second image data is formed in an N-ary form based on the nozzle setting information table.

7. The printing apparatus according to claim 1, wherein:

the nozzle use information setting module creates a nozzle setting information table formed of information that sets whether to use a nozzle corresponding to each item of pixel data for each item of the pixel data in the first image data; and the printing data creating module creates the printing data that the third image data is corrected based on the nozzle setting information table.

8. The printing apparatus according to claim 1, wherein:

the nozzle use information setting module creates a nozzle setting information table formed of information that sets whether to use a nozzle corresponding to each item of pixel data for each item of the pixel data in the first image data; and the printing module prints the image on the medium by the print head based on the printing data and the nozzle setting information table.

9. The printing apparatus according to claim 1, wherein the print head is a print head that the nozzle is continuously arranged across an area equal to a mounting area of the medium or an area wider than the mounting area.

10. The printing apparatus according to claim 1, wherein the print head is a print head that prints as moves in a direction orthogonal to a paper feed direction of the medium.

11. A printing apparatus control program used to control a printing apparatus which is capable of printing an image on a printing medium by a print head having a nozzle that is capable of creating two or more types of dots varied depending on size, the printing apparatus control program including a program used to allow a computer to implement a process comprising:

acquiring first image data having a plurality of items of pixel data corresponding to an M-ary pixel value ($M \geqq 3$);

setting nozzle use information that sets whether to use a nozzle corresponding to each item of pixel data for each item of the pixel data in the first image data based on stored descriptions of the nozzle information storing module in which the nozzle information is stored that indicates a property of the nozzle;

changing to a minimum concentration value a pixel value of pixel data set not to use a nozzle by the nozzle use information setting module in the first image data, and creating second image data that an original pixel value before changed is distributed to a pixel value of an unprocessed pixel located near that pixel value;

performing an N-ary formation process to create third image data, the process being that an M-ary pixel value ($M \geqq 3$) of pixel data in second image data is transformed to an N-ary value ($M > N \geqq 2$);

creating printing data that defines information about dot forming descriptions of the nozzle corresponding to the third image data; and printing the image on the medium by the print head based on the printing data.

12. A printing apparatus control method used to control a printing apparatus which is capable of printing an image on a printing medium by a print head having a nozzle that is capable of creating two or more types of dots varied depending on size, the printing apparatus control method comprising:

acquiring first image data having a plurality of items of pixel data corresponding to an M-ary pixel value ($M \geqq 3$);

setting nozzle use information that sets whether to use a nozzle corresponding to each item of pixel data for each item of the pixel data in the first image data based on stored descriptions of the nozzle information storing module in which the nozzle information is stored that indicates a property of the nozzle;

changing to a minimum concentration value a pixel value of pixel data set not to use a nozzle by the nozzle use information setting module in the first image data, and creating second image data that an original pixel value before changed is distributed to a pixel value of an unprocessed pixel located near that pixel value;

performing an N-ary formation process to create third image data, the process being that an M-ary pixel value ($M \geqq 3$) of pixel data in second image data is transformed to an N-ary value ($M > N \geqq 2$);

creating printing data that defines information about dot forming descriptions of the nozzle corresponding to the third image data; and printing the image on the medium by the print head based on the printing data.

* * * * *